US006980756B2

(12) United States Patent
Kubota

(10) Patent No.: US 6,980,756 B2
(45) Date of Patent: Dec. 27, 2005

(54) PROCESS CARTRIDGE, ELECTROPHOTOGRAPHIC IMAGE FORMING APPARATUS, AND PROCESS CARTRIDGE MOUNTING SYSTEM

(75) Inventor: Takeshi Kubota, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/670,329

(22) Filed: Sep. 26, 2003

(65) Prior Publication Data

US 2004/0105699 A1 Jun. 3, 2004

(30) Foreign Application Priority Data

Sep. 30, 2002 (JP) ..... 2002-286918

(51) Int. Cl.[7] ..... G03G 21/16
(52) U.S. Cl. ..... 399/111; 399/12
(58) Field of Search ..... 399/12, 13, 111, 399/113, 119

(56) References Cited

U.S. PATENT DOCUMENTS

| | | | | |
|---|---|---|---|---|
| 5,014,094 | A | 5/1991 | Amitani et al. | 355/326 |
| 5,559,581 | A | 9/1996 | Sugiura et al. | |
| 5,561,496 | A | 10/1996 | Sugiura et al. | |
| 5,634,178 | A | 5/1997 | Sugiura et al. | 399/110 |
| 5,903,803 | A | 5/1999 | Kawai et al. | 399/116 |
| 5,907,751 | A | 5/1999 | Kawaguchi et al. | 399/117 |
| 5,911,096 | A | 6/1999 | Batori et al. | 399/111 |
| 5,943,529 | A | 8/1999 | Miyabe et al. | 399/111 |
| 6,084,622 | A | 7/2000 | Sugiura et al. | 347/170 |
| 6,714,750 | B2 | 3/2004 | Terada et al. | 399/111 |
| 2002/0009175 | A1 | 1/2002 | Kurosawa | 378/34 |

FOREIGN PATENT DOCUMENTS

| | | |
|---|---|---|
| JP | 59-31976 A | 2/1984 |
| JP | 04-156469 | 5/1992 |
| JP | 8-106207 | 4/1996 |
| JP | 2001-066969 | 3/2001 |
| JP | 2001-337578 | 12/2001 |
| JP | 2002-229416 A | 8/2002 |

*Primary Examiner*—Hoang Ngo
(74) *Attorney, Agent, or Firm*—Fitzpatrick, Cella, Harper & Scinto

(57) ABSTRACT

Provided is a process cartridge detachably mountable to a main body of an electrophotographic image forming apparatus having a guide member, including: a cartridge frame; an electrophotographic photosensitive drum; process unit acting on the electrophotographic photosensitive drum; and a projecting portion which is provided in the cartridge frame and, when the process cartridge is mounted to the main body of the electrophotographic image forming apparatus, is guided to the guide member to guide the process cartridge in a mounting direction in which the process cartridge is mounted to the main body of the electrophotographic image forming apparatus, in which: when the process cartridge is mounted to the main body of the electrophotographic image forming apparatus which is conformable in functions of the process cartridge, the projecting portion allows the process cartridge to insert the main body of the electrophotographic image forming apparatus; and when the process cartridge is mounted to a main body of an electrophotographic image forming apparatus which is unconformable in functions of the process cartridge and having different functions, the projecting portion abuts against a main body frame provided in the main body of the electrophotographic image forming apparatus having different functions to prevent mounting of the process cartridge.

10 Claims, 22 Drawing Sheets

PROCESS CARTRIDGE, ELECTROPHOTOGRAPHIC IMAGE FORMING APPARATUS, AND PROCESS CARTRIDGE MOUNTING SYSTEM

FIELD OF THE INVENTION AND RELATED ART

The present invention relates to a process cartridge which is detachably mountable to a main body of an electrophotographic image forming apparatus such as a copying machine or a laser beam printer (LBP), an electrophotographic image forming apparatus to which this process cartridge is detachably mounted, and a process cartridge mounting system.

Note that the process cartridge is provided with an electrophotographic photosensitive member and at least one process means. Here, examples of the process means include charging means which charges the electrophotographic photosensitive member, developing means which develops an electrostatic latent image formed on the electrophotographic photosensitive member, and cleaning means which cleans a toner remaining on the electrophotographic photosensitive member.

Conventionally, in an image forming apparatus of an electrophotographic process such as a small-sized copying machine or a laser beam printer (herein after referred to as LBP), a process cartridge constituting an image forming section thereof is set detachably mountable to a main body of the apparatus, whereby it is possible to replace the process cartridge (e.g., JP 08-106207 A, U.S. Pat. No. 5,907,751, and U.S. Pat. No. 5,943,529).

Here, the electrophotographic image forming apparatus is constituted such that only a designated specific process cartridge can be properly mounted to the apparatus.

That is, the process cartridge or the main body of the apparatus is constituted to have cartridge non-interchangeability for not allowing an undesignated process cartridge to be mounted to the apparatus even if an attempt is made to mount the undesignated process cartridge (e.g., U.S. Pat. No. 5,911,096).

This is realized because, in an image forming apparatus of a specification, a type, or the like different from another image forming apparatus, a process cartridge to be used therefor has different functions and thus, the process cartridge is suitable for image formation in the other apparatus.

If an incompatible process cartridge is mounted by mistake, satisfactory image formation is not performed.

Thus, conventionally, there has been known a method of using a sensor for judgment of interchangeability, a method of making an image forming apparatus engageable only with a driven gear of a conformable process cartridge, or the like.

However, if the sensor for judgment of interchangeability is used, an expensive sensor for judgment of interchangeability is required. Further, it is also necessary to attach a component for operating the sensor for judgment of interchangeability on the process cartridge side. Accordingly, an increase in cost is caused.

In addition, if the image forming apparatus is constituted to be given non-interchangeability depending upon whether the gear engages or not, since interchangeability is judged in the vicinity of a proper position of the process cartridge, timing for judging interchangeability is delayed.

SUMMARY OF THE INVENTION

The present invention has been devised in view of the above-mentioned related art. It is an object of the present invention to provide a process cartridge, an electrophotographic image forming apparatus, and a process cartridge mounting system which have a non-interchangeable function. It is another object of the present invention to provide a process cartridge, an electrophotographic image forming apparatus, and a process cartridge mounting system which reliably have a non-interchangeable function with a simple structure while sharing components of a process cartridge frame. It is another object of the present invention to provide a process cartridge, an electrophotographic image forming apparatus, and a process cartridge mounting system which have a projecting portion which is provided in the cartridge frame and, when the process cartridge is mounted to the main body of the electrophotographic image forming apparatus, is guided to the guide member to guide the process cartridge in a mounting direction in which the process cartridge is mounted to the main body of the electrophotographic image forming apparatus, wherein, when the process cartridge is mounted to the main body of the electrophotographic image forming apparatus which is conformable in functions of the process cartridge, the projecting portion allows the process cartridge to insert the main body of the electrophotographic image forming apparatus and, when the process cartridge is mounted to a main body of an electrophotographic image forming apparatus which is unconformable in functions of the process cartridge and having different functions, the projecting portion abuts against a main body frame provided in the main body of the electrophotographic image forming apparatus having different functions to prevent mounting of the process cartridge.

DETAILED DESCRIPTION OF THE PREFERRED EMBODIMENT

Next, an embodiment in accordance with the present invention will be described in detail with reference to the accompanying drawings. A laser beam printer will be described as an embodiment of an image forming apparatus, a process cartridge and a process cartridge mounting system.

In the following description, a longitudinal direction of the process cartridge refers to a direction crossing (substantially perpendicular to) a mounting and dismounting direction of the process cartridge with respect to a main body of the image forming apparatus. Alternatively, the longitudinal direction refers to a direction parallel with a surface of a recording medium and crossing (substantially perpendicular to) a conveying direction of the recording medium. In addition, the left and right refers to the left and right of the recording medium viewed from a position above it in accordance with the conveying direction thereof. In addition, an upper surface of the process cartridge is a surface located at a top in a state in which the process cartridge is mounted to the main body of the apparatus, and a lower surface is a surface located at the bottom.

As an order of the description, first, an entire structure of the process cartridge and an electrophotographic image forming apparatus using the process cartridge will be described. Next, a structure of the process cartridge mounting system for mounting and dismounting the process cartridge to and from a main body of the electrophotographic image forming apparatus will be described. Then, lastly, a structure of an erroneous insertion preventing mechanism for an improper process cartridge will be described.

Figure 2:
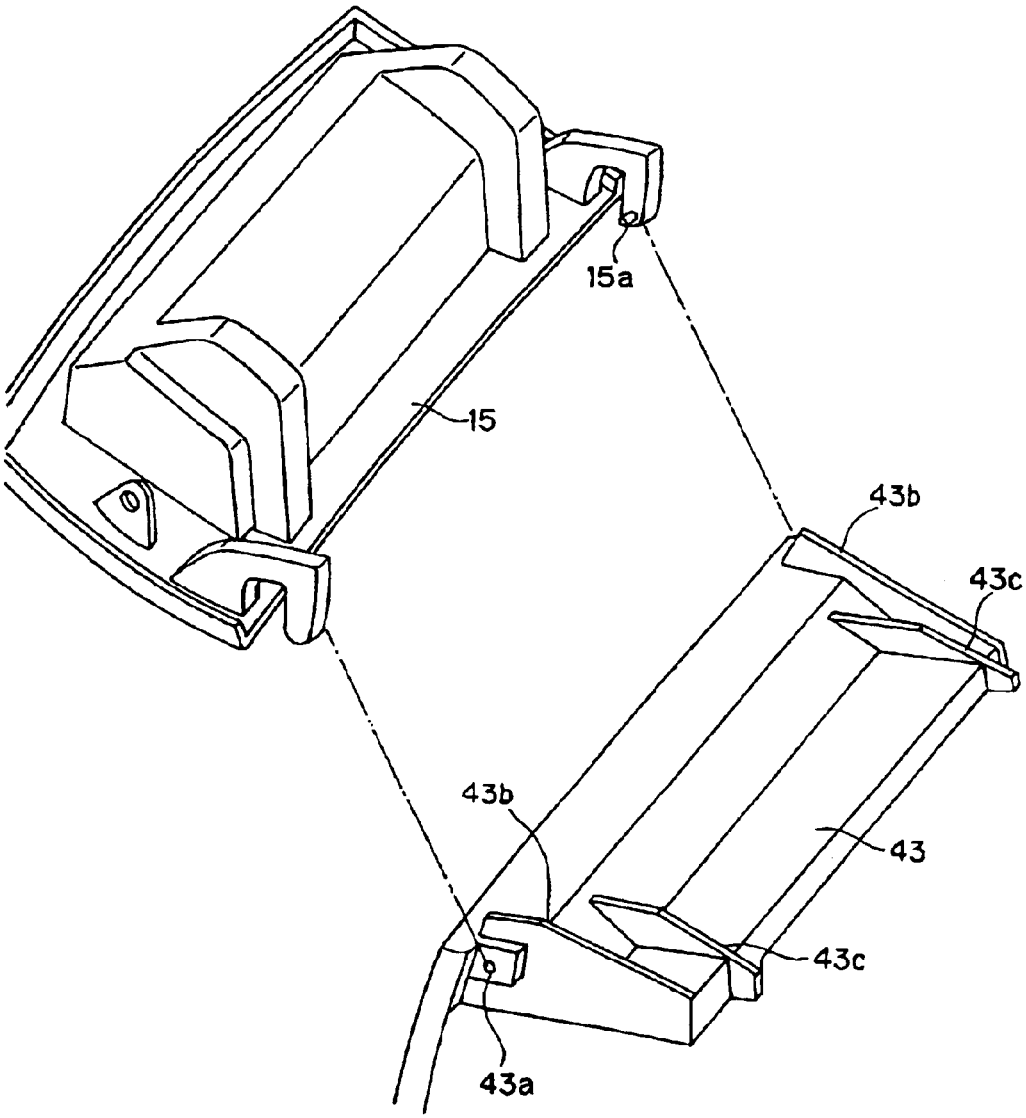
FIG. 2 is a perspective view showing the vicinity of an open/close cover of the electrophotographic image forming apparatus.
Figure 3:
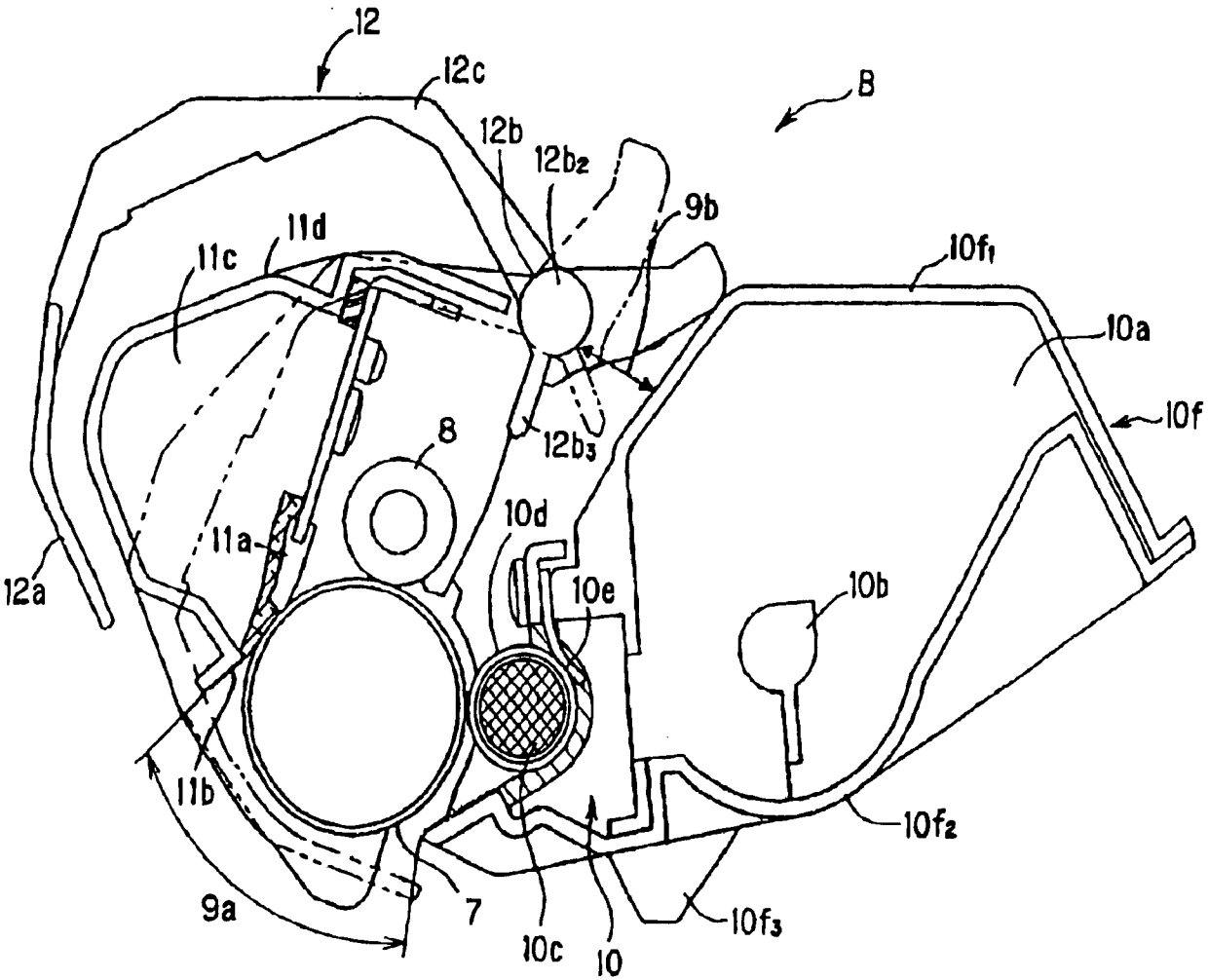
FIG. 3 is a sectional view showing a schematic structure of a process cartridge.

The process cartridge and the electrophotographic image forming apparatus to which the process cartridge is detachably mountable will be specifically described with reference to FIGS. 1 to 3. Note that FIG. 1 is a schematic explanatory view of a structure of the electrophotographic image forming apparatus mounted with the process cartridge, FIG. 2 is an explanatory view showing the vicinity of an open/close cover of the electrophotographic image forming apparatus, and FIG. 3 is a schematic explanatory view of a structure of the process cartridge.

(Overall Structure)

Figure 1:
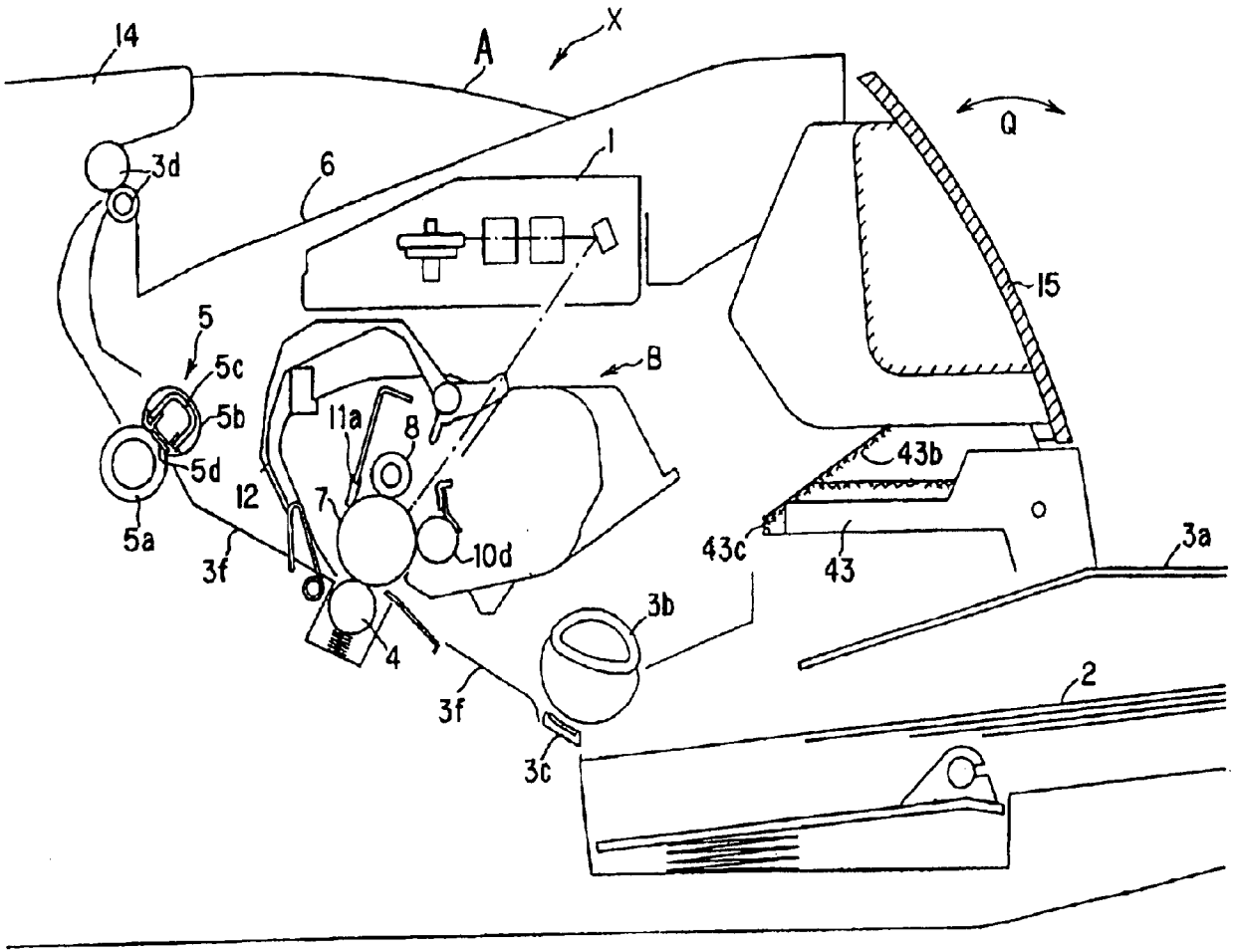
FIG. 1 is a sectional view showing a schematic structure of an electrophotographic image forming apparatus.

As shown in FIG. 1, an electrophotographic image forming apparatus A (laser beam printer, hereinafter referred to as "image forming apparatus") irradiates information light, which is based upon image information from an optical system 1 serving as optical means, on an electrophotographic. photosensitive drum 7 of a drum shape (hereinafter referred to as "photosensitive drum"). Consequently, the image forming apparatus A forms an electrostatic latent image on the photosensitive drum 7. Then, the image forming apparatus A develops this electrostatic latent image with a developer (hereinafter referred to as "toner") to form a toner image.

Then, in synchronization with the formation of the toner image, the image forming apparatus A separates and feeds a recording medium (recording paper, OHP sheets, cloth, etc.) 2 from a cassette 3*a* one by one with a pickup roller 3*b* and a press contact member 3*c* which is in pressed contact with the pickup roller 3*b*. Then, the image forming apparatus A transfers the toner image, which is formed on the photosensitive drum 7 provided in a process cartridge B, to the recording medium 2 by applying a voltage to a transfer roller 4 serving as transfer means. The image forming apparatus A conveys the recording medium 2 to fixing means 5 with a conveying guide 3*f*.

This fixing means 5 includes a drive roller 5*a* and a fixing rotary member 5*b* which contains a heater 5*d* and is constituted by a cylindrical sheet rotatably supported by a support member 5*c*. Then, the fixing means 5 applies heat and pressure to the recording medium 2 passing the fixing means 5 to fix a transfer toner image on the recording medium 2.

Then, the image forming apparatus A conveys the recording medium 2 having this toner image fixed thereon with a delivery roller 3*d*. Thereafter, the image forming apparatus A delivers the recording medium 2 to a delivery section 6 through a reverse conveying path.

Note that, in this embodiment, conveying means 3 is constituted by the pickup roller 3*b*, the press contact member 3*c*, the delivery roller 3*d*, and the like.

A main body of the electrophotographic image forming apparatus (hereinafter referred to as "main body of the apparatus" or "main body") 14 includes the conveying means 3, the fixing means 5, and drive means for driving the process cartridge B. The drive means drives each rotary member by transmitting a drive force from a motor (not shown) serving as a drive source with a gear train (not shown).

A drive force is also transmitted to a large gear via the gear train (not shown) and, then, transmitted to the process cartridges by this large gear. The transmission of the drive force between the large gear and the process cartridge B is carried out by coupling means described in U.S. Pat. No. 5,903,803.

The coupling means is constituted by a large gear coupling, which is formed coaxially with a rotary shaft of the large gear and has a twisted hole with a section of a substantially equilateral triangle shape, and a drum coupling 7*a*1 which is formed in a gear flange 7*a* fixed to one end of the photosensitive drum 7 coaxially with a rotary shaft of the photosensitive drum 7 and is formed in a twisted projected shape with a section of a substantially equilateral triangle shape. The transmission of the drive force and aligning and positioning of the large gear and the photosensitive drum 7 are performed by coupling of this coupling means. Drive coupling means which performs coupling and release of this coupling means is also provided.

In addition, as shown in FIG. 2, a front guide 43, which has support holes 43*a* rotatably supporting pivotal center bosses 15*a* of an open/close cover 15, is fixed between left and right side plates 40.

In this front guide 43, side guides 43*b*, whose inner surfaces are set in longitudinal positions having a distance from each other the same as or closer than a distance between inner surfaces of moving guides 41 and which perform guiding of projecting portions 10*f*4 of the process cartridge B and guiding of a longitudinal direction position of the process cartridge B, and abutment ribs 43*c*, which abut against leg portions 10*f*3 of the process cartridge B on inner sides in the longitudinal direction than the side guides 43*b*, are provided two places in the vicinity of both ends in the longitudinal direction, respectively.

(Process Cartridge)

Figure 4:
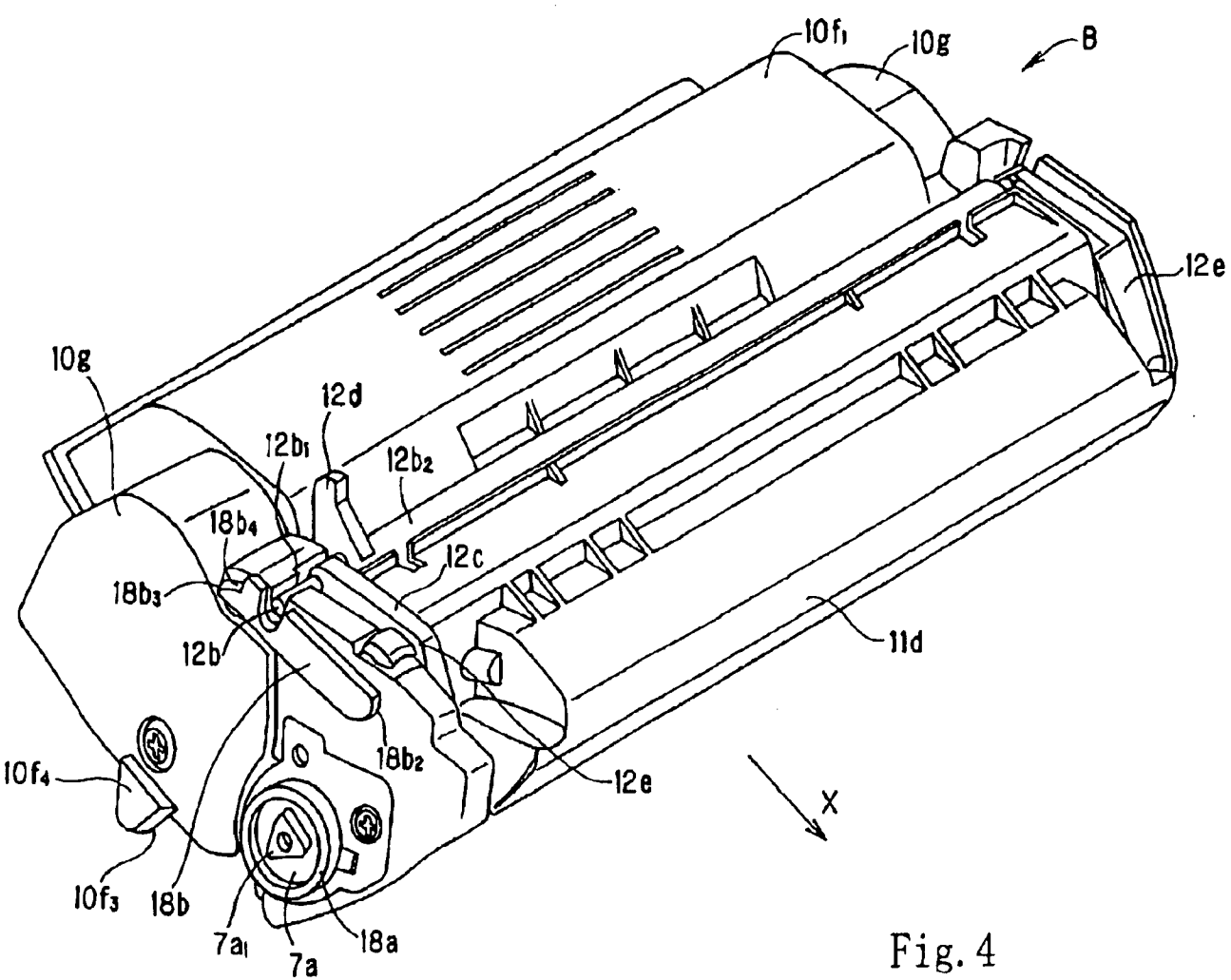
FIG. 4 is a perspective view of the process cartridge.
Figure 5:
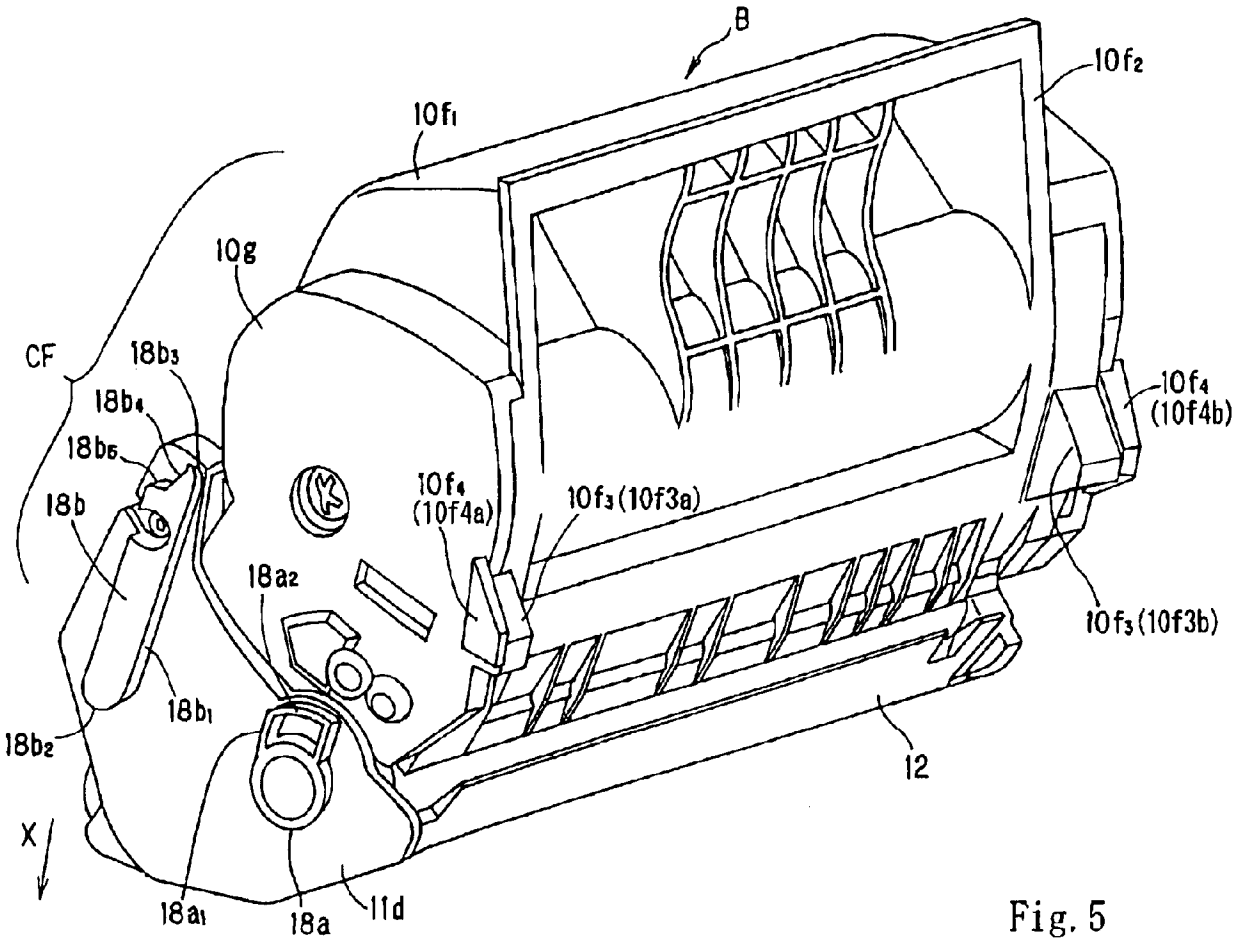
FIG. 5 is a perspective view of the process cartridge.

As shown in FIGS. 3 to 5, the process cartridge B of this embodiment rotates the photosensitive drum 7 which is an electrophotographic photosensitive member having a photosensitive layer with the drive force received from the main body 14 of the apparatus. Then, A charging roller 8 serving as charging means is applied a voltage to uniformly charge the surface of the photosensitive drum 7. Then, the main body 14 irradiates information light (photo image), which is based upon image information from the optical system 1, on the charged photosensitive drum 7 through an exposure opening 9*b* for exposure to form an electrostatic latent image on the surface of the photosensitive drum 7. Then, the developing means 10 develops the electrostatic latent image.

The developing means 10 feeds a toner in a toner containing portion 10*a* with a rotatable feeding member 10*b* serving as toner feeding means. Then, the developing means 10 rotates a developing roller 10*d* serving as a developing rotary member (developer carrying member) containing a fixed magnet 10*c*. Then, the developing means 10 forms a toner layer, to which a triboelectric charge is applied, on the surface of the developing roller 10*d* with a developing blade 10*e*. Then, the developing means 10 forms a toner image by transferring the toner to the photosensitive drum 7 according to the electrostatic latent image to visualize the electrostatic latent image.

After applying a voltage of a polarity opposite to that of the toner image to the transfer roller 4 to transfer the toner image to the recording medium 2, A cleaning blade 11*a* scrapes off the toner remaining on the photosensitive drum 7. The scraped-off toner is scooped by a scoop sheet 11*b* and collected in a removed toner containing section 11*c*. In this way, the cleaning means 11 removes the residual toner on the photosensitive drum 7.

The process cartridge B described in this embodiment includes a cleaning frame 11*d*, which rotatably supports the photosensitive drum 7 and incorporates the cleaning means 11 and the charging roller 8, and a toner development frame 10*f* which incorporates the developing member 10 and the toner containing portion 10*a*.

Further, the toner development frame 10*f* is pivotably supported with respect to the cleaning frame 11*d* such that the developing roller 10*d* of the developing means 10 can be opposed to the photosensitive drum 7 in parallel with a predetermined space between them. In addition, spacers (not shown) for keeping the space between the developing roller 10*d* and the photosensitive drum 7 are arranged at both ends of the developing roller 10*d*.

Holder members log are provided on both sides of the toner development frame 10*f* and have hanging arms, in which connection holes are formed, for rotatably hanging the toner development frame 10*f* to the cleaning frame 11*d*. A predetermined pressure is applied between the toner development frame 10*f* and the cleaning frame 11*d* in order to keep a space between them.

The cartridge B is formed by being housed in a cartridge frame CF constituted by combining: the toner development frame 10*f*, which is formed as a united body by welding a development frame 10*f*1 and a cover member 10*f*2, and the cleaning frame 11*d*.

Further, as shown in FIGS. 4 and 5, mounting guides 18*b* for detachably mounting the cartridge B to the main body 14 of the apparatus in a direction of arrow X are provided on both sides in a longitudinal direction of this cartridge frame CF. In addition, positioning guides 18*a*, which are located coaxially with the rotary shaft of the photosensitive drum 7 and supported by positioning means in the image forming apparatus, are provided.

The positioning guides 18*a* are cylindrical bosses on the left and right having different sizes. A mounting assist guide 18*a*1 extended to the rear in the mounting direction of the cartridge B is provided in the guide 18*a* on a counter drive side (In the longitudinal direction of the cartridge B, the opposition side which the drum coupling 7*a*1 is provided). In addition, a biased portion 18*a*2 which is an arc coaxial with the guides 18*a* is provided at a rear end of this guide 18*a*1.

Lower surfaces 18*b*1, which are received by a moving guides 41 described later, and tip portions 18*b*2 that are tips of amounting guides 18*b* in the inserting direction of the cartridge B are provided in the mounting guides 18*b*.

In these tip portions 18*b*2, arcs linked to the lower surfaces 18*b*1 are set larger than arcs linked with upper surfaces of the mounting guides 18*b*.

Slope portions 18*b*4 with an angle with respect to the lower surfaces 18*b*1 set as an acute angle are provided at rear end lower corners 18*b*3 that are rear end corners of the lower surfaces 18*b*1 in the inserting direction. In addition, perpendicular surfaces 18*b*5 perpendicular to the upper surfaces are provided at rear ends of the upper surfaces in the inserting direction.

Rear ends of the mounting guides 18*b* are provided up to the rear side of the cartridge B than a center of gravity position thereof. Consequently, when the cartridge B is supported by the mounting guides 18*b*, the cartridge B always keeps a posture inclined to the front. In this embodiment, the mounting guides 18*b* are provided on the sides of the cleaning frame 11*d* at a position above the positioning guides 18*a*.

In addition, leg portions 10*f*3 for allowing the cartridge B to be placed stably on a desk are provided at longitudinal ends of the cover member 10*f*2. Moreover, extended shapes of the leg portions 10*f*3 are provided in holder members 10*g* provided on the outer side of the cover member 10*f*2.

As shown in FIG. 5, a projecting portion 10*f*4 (10*f*4*a*) is provided on the outer side of the leg portion 10*f*3 (10*f*3*a*) of the holder member 10*g* on the counter drive side which constitutes one end in the longitudinal direction of the cartridge B of this embodiment. The leg portion 10*f*3 (10*f*3*a*) and the projecting portion 10*f*4 (10*f*4*a*) at one end in the longitudinal direction of the cartridge B are integrally formed in a shape of one projection.

In addition, as shown in FIG. 5, a projecting portion 10*f*4 (10*f*4*b*) is provided on the outer side of the leg portion 10*f*3

(10*f*3*b*) of the holder member log on the drive side (In the longitudinal direction of the cartridge B, the same side which the drum coupling 7*a*1 is provided) which constitutes the other end in the longitudinal direction of the cartridge B. The leg portion 10*f*3 (10*f*3*b*) and the projecting portion 10*f*4 (10*f*4*b*) on the other end in the longitudinal direction of the cartridge B are also integrally formed in a shape of one projection.

Figure 6:
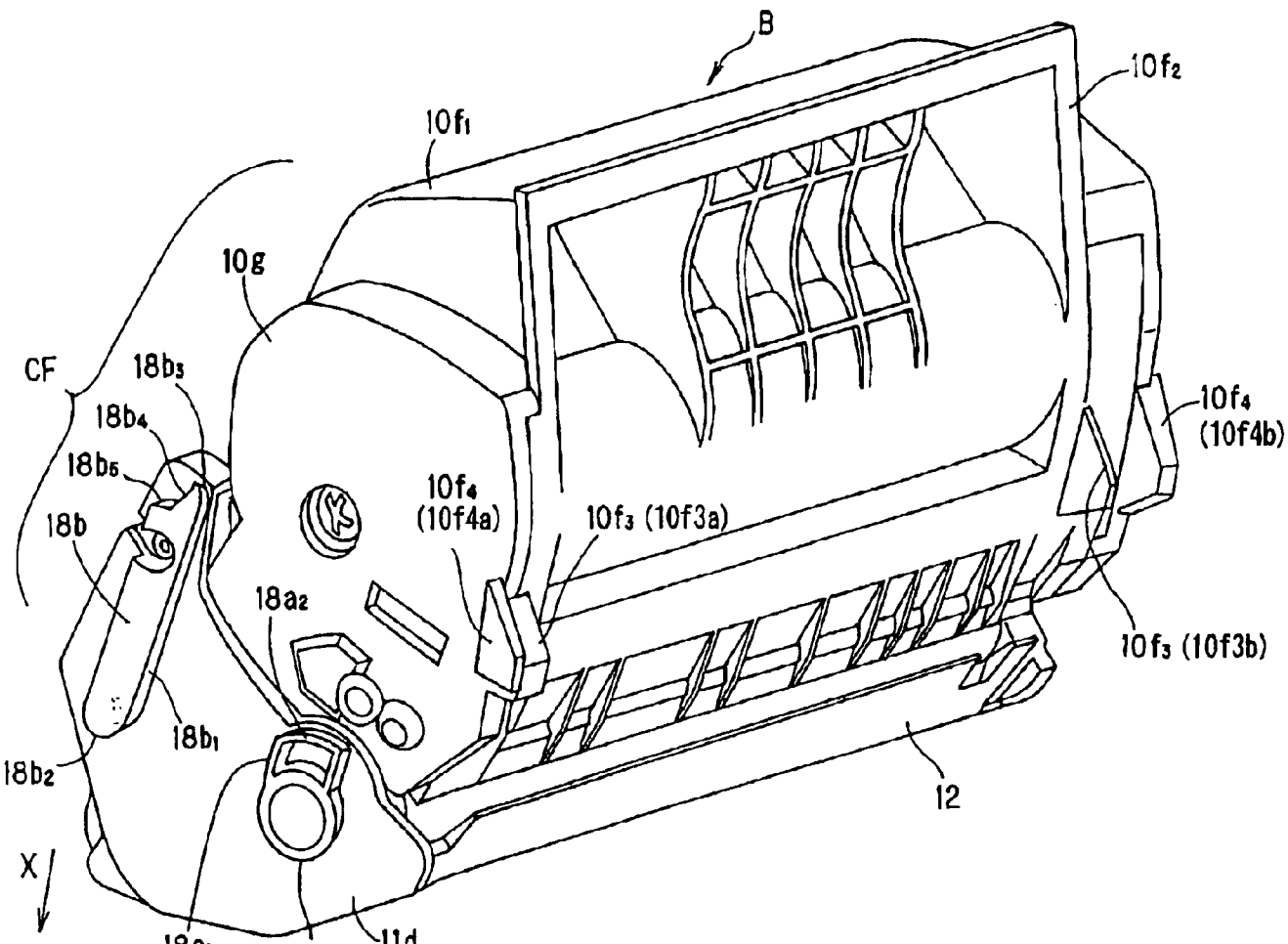
FIG. 6 is a perspective view of a process cartridge of another embodiment.

Note that, in another embodiment, for example, as shown in FIG. 6, the projecting portion 10*f*4 (10*f*4*b*) may be provided across a gap on the outer side of the leg portion 10*f*3 (10*f*3*b*) of the holder member 10*g* on the drive side to form a leg portion of a forked shape.

In the cartridge B of this embodiment, a drum shutter 12, which can integrally cover a transfer opening 9*a* opposed to the transfer roller 4 of the photosensitive drum 7 and an exposure opening 9*b*, is rotatably provided on the cleaning frame 11*d*.

A structure of the shutter 12 will be described. The shutter 12 includes a drum protecting portion 12*a*, a rotary shaft 12*b*, coupling portion 12*c*, a cam section 12*d*, and a rib 12*e*.

The protecting portion 12*a* can cover the transfer opening 9*a* where the photosensitive drum 7 abuts against the transfer roller 4.

The rotary shaft 12*b* is provided such that the shutter 12 is rotatably supported in the vicinity of the exposure opening 9*b* of the cleaning frame 11*d*. In the shaft 12*b*, there are provided a sliding portion 12*b*1, which slides with respect to the cleaning frame 11*d* at both ends of the rotary shaft 12*b*, a large diameter portion 12*b*2, which is thicker than the sliding portion 12*b*1 in parts covering the exposure opening 9*b* connecting the sliding portion 12*b*1 at both ends, and an exposure shutter portion 12*b*3, which blocks the exposure opening 9*b* in a state in which the shutter 12 is closed in the large diameter portion 12*b*2.

The coupling portion 12*c* are provided in left and right two parts connecting the protecting portion 12*a* and the shaft 12*b* at both ends of the protecting portion 12*a* and on the outer side of the large diameter portion 12*b*2 of the shaft 12*b*.

The cam portion 12*d* is arranged on the right side of the large diameter portion 12*b*2 of the shaft 12*b* and projects above the cartridge B.

The rib 12*e* is provided in the coupling portion 12*c* on the right side and extends to the outer side in the longitudinal direction of the shutter 12. The rib 12*e* is received by a shutter guide 44*c* of a fixed guide 44 and keeps a posture with the shutter 12 opened.

A biasing force is applied to this shutter 12 in a direction in which the shutter 12 covers the photosensitive drum 7 by a spring force of a torsion coil spring (not shown).

Consequently, in a state in which the cartridge B is removed from the main body 14, the shutter 12 keeps covering to close the transfer opening 9*a* as indicated by alternate long and two dash lines of FIG. 3. In addition, in a state in which the cartridge B is in the main body 14 of the apparatus A and capable of performing an image forming operation, the shutter 12 is rotated by shutter opening/closing means described later, and takes a posture in which the transfer opening 9*a* is exposed and the photosensitive drum 7 and the transfer roller 4 are capable of abutting against each other as shown by solid lines of FIG. 3.

(Mounting of the Process Cartridge to the Main Body 14 of the Apparatus A)

Next, an inserting operation of the cartridge B by a process cartridge mounting/dismounting mechanism serving as mounting means will be described with reference to FIGS. 7 to 12.

Figure 7:
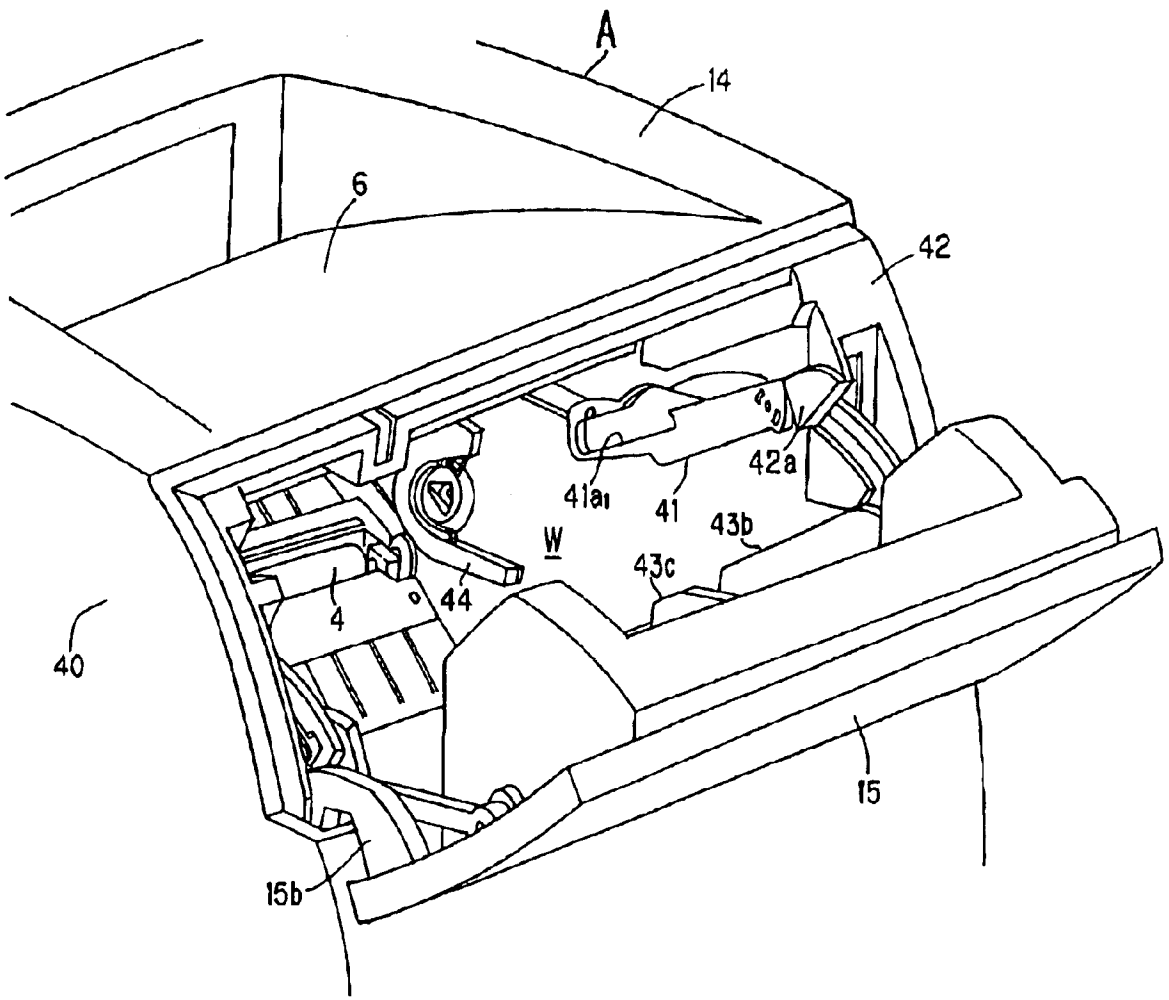
FIG. 7 is a perspective view of a process cartridge mounting/dismounting mechanism.
Figure 8:
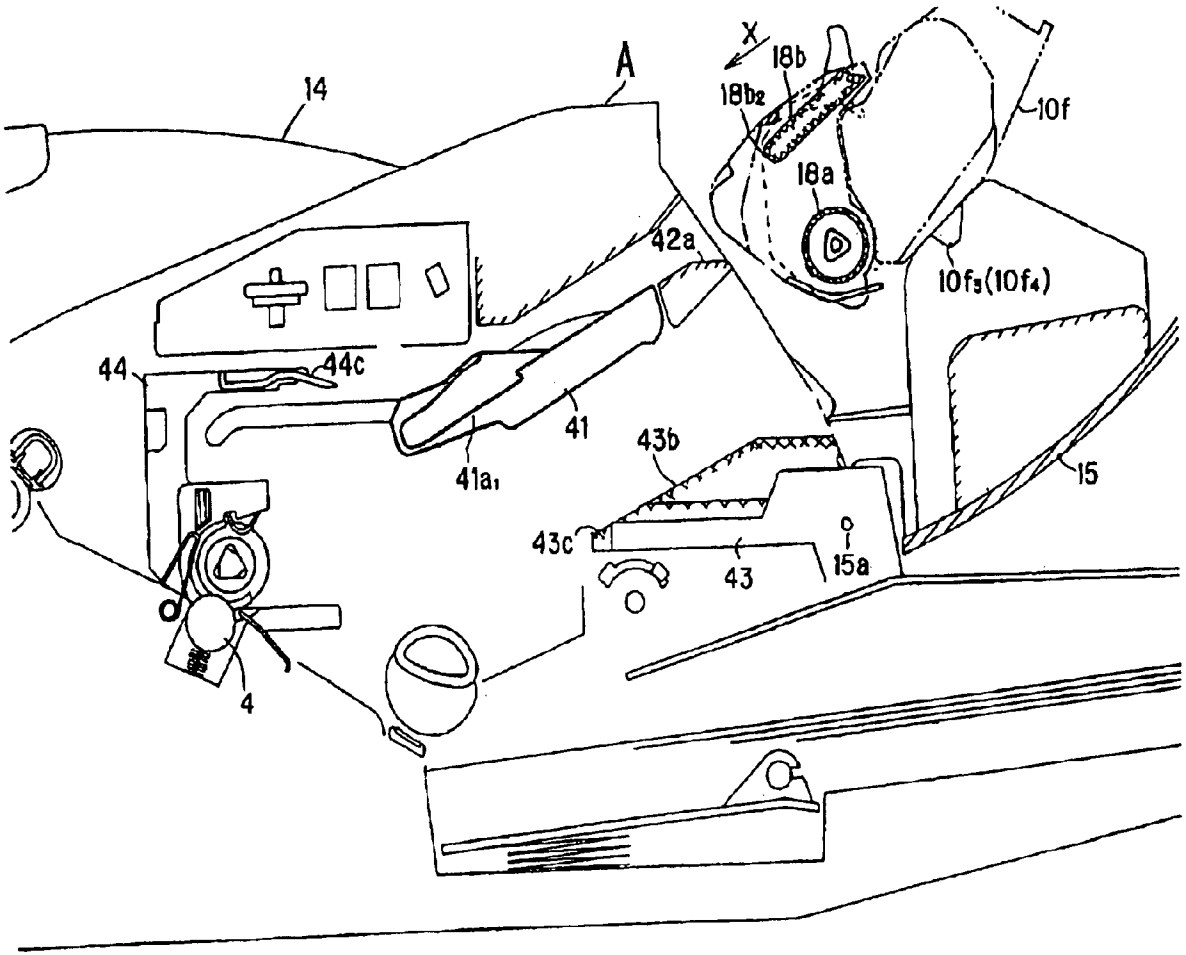
FIG. 8 is an explanatory view of an inserting operation of the process cartridge into the process cartridge mounting/dismounting mechanism shown in FIG. 7.
Figure 9:
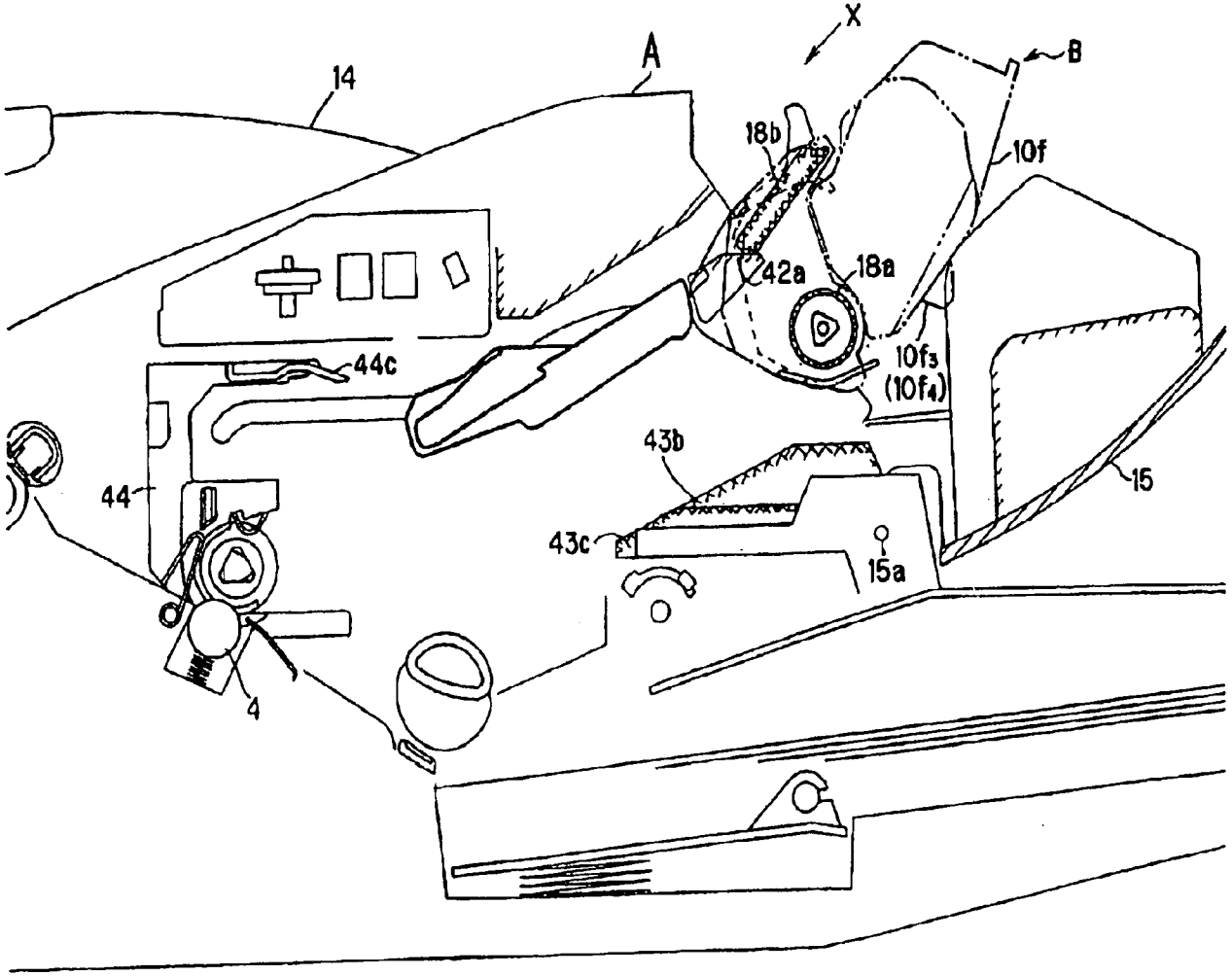
FIG. 9 is an explanatory view of the inserting operation of the process cartridge into the process cartridge mounting/dismounting mechanism shown in FIG. 7.
Figure 10:
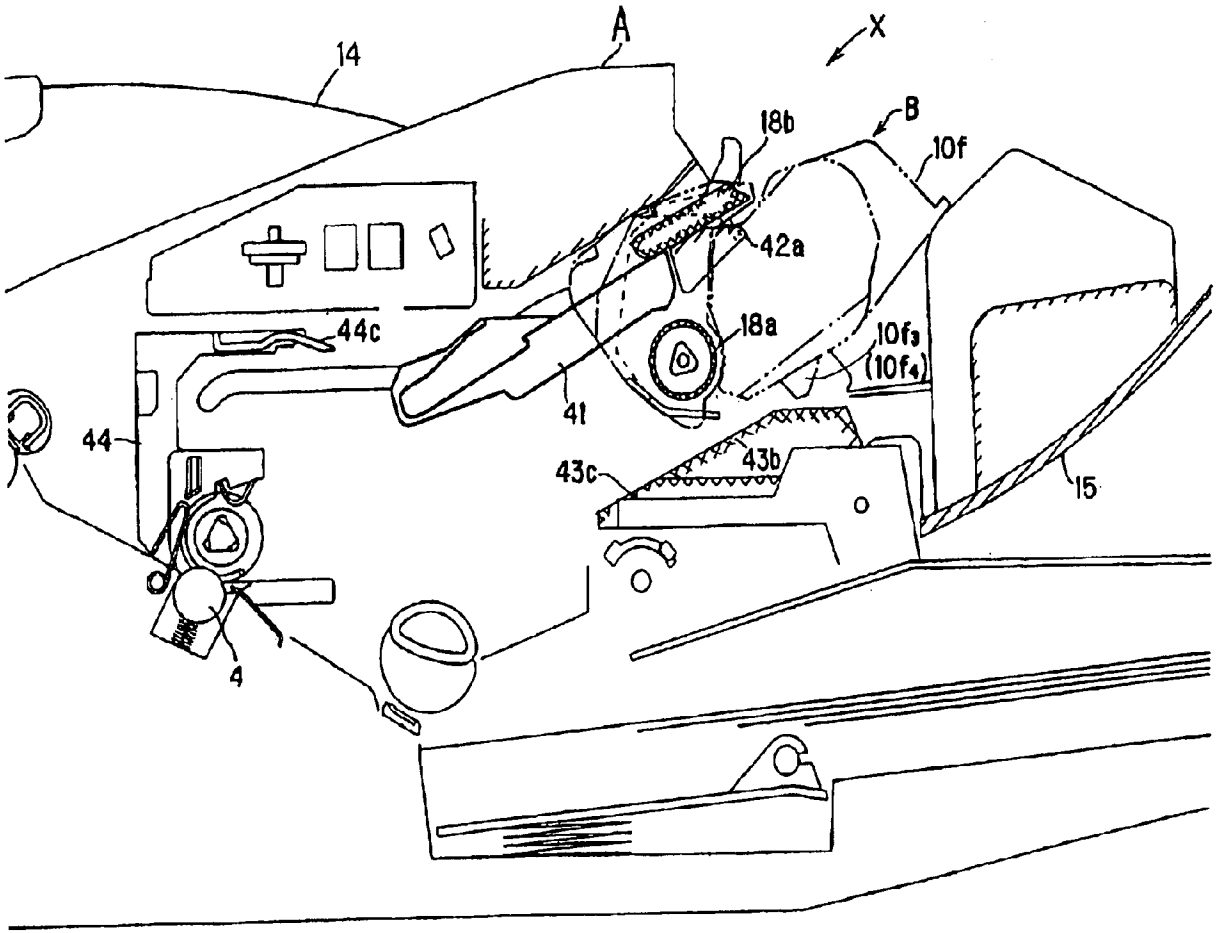
FIG. 10 is an explanatory view of the inserting operation of the process cartridge into the process cartridge mounting/dismounting mechanism shown in FIG. 7.

When the open/close cover 15 of the main body 14 is completely opened (fully opened state), an opening W for mounting and dismounting the cartridge B appears. In this state, as shown in FIG. 7, the moving guides 41 appear in a posture in which they are receded to a depth side in the inserting direction of the cartridge B. Auxiliary guides 42 are fixed to the side plates 40 substantially symmetrically on an upstream side in the inserting direction of the moving guides 41. In addition, the front guide 43 described above is arranged below the opening W.

As described above, the cartridge B is provided with positioning guides 18*a*, which are formed coaxially with the rotary shaft of the photosensitive drum 7 on both the sides of the cartridge frame CF, and the mounting guides 18*b* of a rib shape provided along the mounting and dismounting direction of the cartridge B.

Moreover, the leg (projecting) portions 10*f*3 are provided in the vicinity of both the ends in the longitudinal direction on the lower surface of the toner development frame 10*f*, and the projecting portion 10*f*4 is provided on the outer side thereof.

An operation in accordance with an order of insertion in inserting the cartridge B from the opening W will be described.

The auxiliary guides 42 is caused to receive the mounting guides 18*b* and to function as rough guides for determining a position for inserting the cartridge B into the main body.

Figure 11:
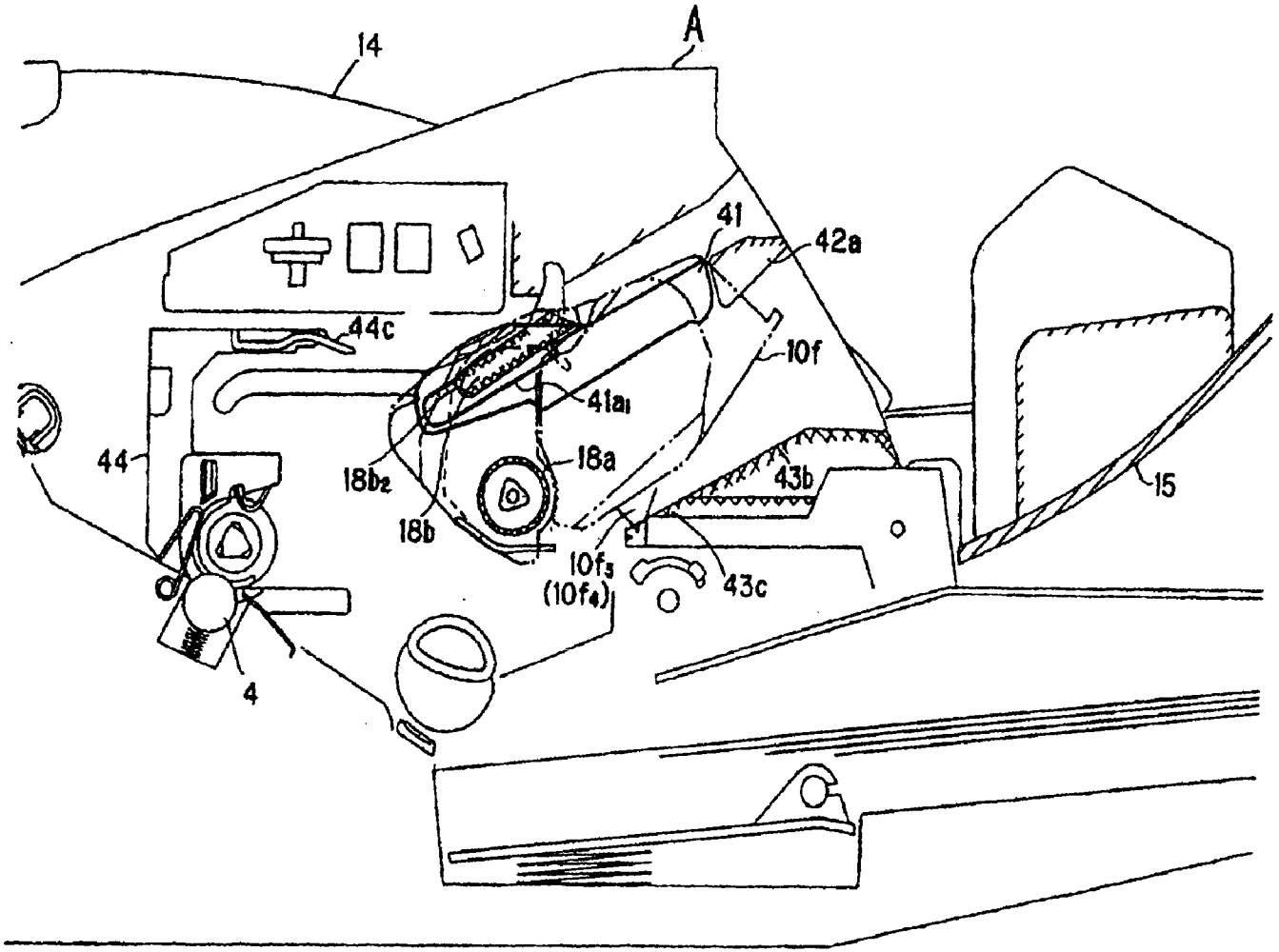
FIG. 11 is an explanatory view of the inserting operation of the process cartridge into the process cartridge mounting/dismounting mechanism shown in FIG. 7.

Moreover, when the cartridge B is inserted along the auxiliary guides 42, as shown in FIG. 11, the two projecting portions 10*f*4 abut against the side guides 43*b*, which are formed at both the ends in the longitudinal direction of the front guide 43, and are guided in such a manner that they mount onto the side guides 43*b*. Consequently, the cartridge B is inserted into the main body 14 in a stable posture.

In that case, the side guides 43*b* formed at both the ends in the longitudinal direction of the front guide 43 have a shape and are provided in a position so that the side guides 43*b* do not abut against the leg portions 10*f*3 and the projecting portions 10*f*4 and do not prevent the insertion when the cartridge B is inserted, thereby guiding the projecting portions 10*f*4. Thus, the cartridge B is inserted into the main body 14 smoothly.

Figure 12:
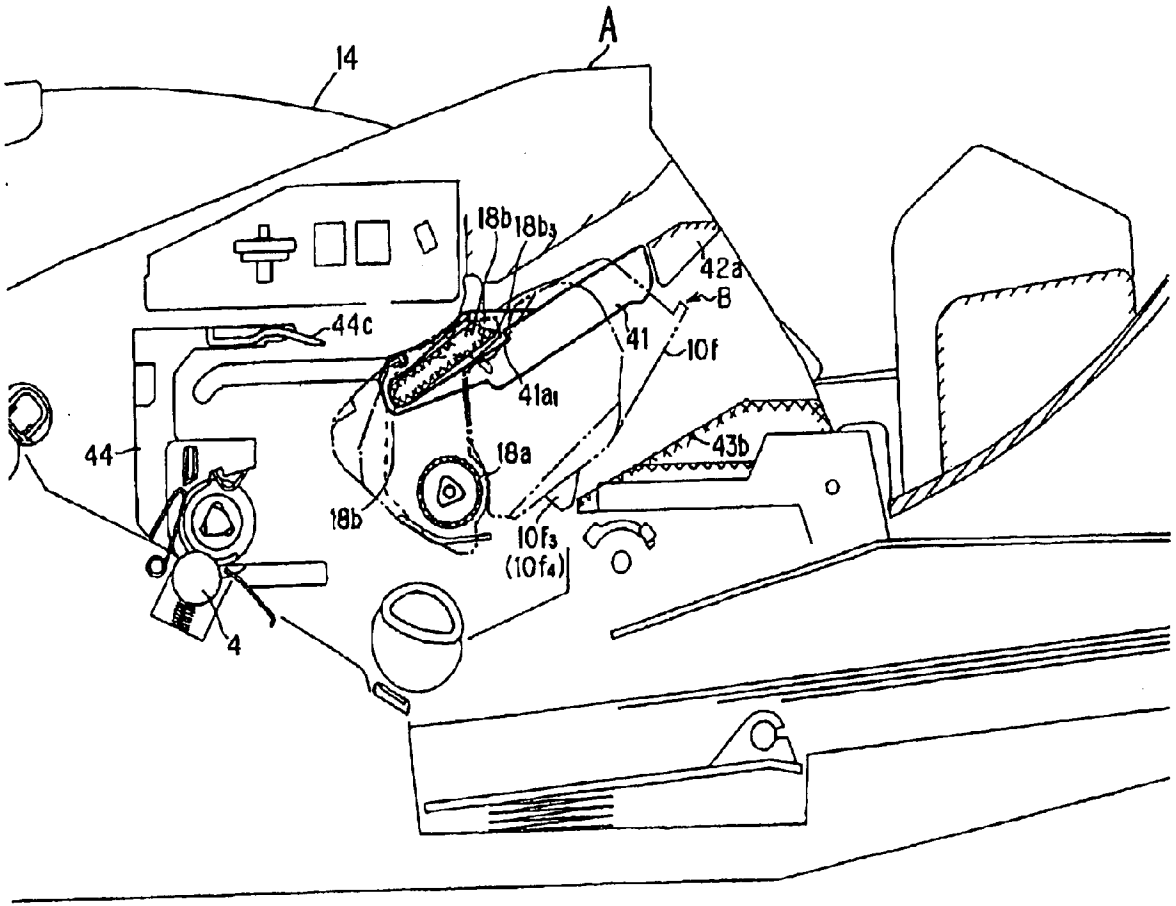
FIG. 12 is an explanatory view of the inserting operation of the process cartridge into the process cartridge mounting/dismounting mechanism shown in FIG. 7.

Thereafter, as shown in FIG. 12, the mounting guides 18*b* are received by the moving guides 41.

The moving guides 41 move to the inside of the main body 14 of the apparatus A in association with opening and closing operations of the open/close cover 15. Then, the cartridge B is mounted in a regular mounting position in the main body 14 of the apparatus A.

Since the moving guides 41 are set up to the rear side in the inserting direction than the center of gravity position of the cartridge B, the cartridge B takes a posture lifting the toner development frame 10*f* in which the cartridge B is on the rear side in the inserting direction when the mounting is completed.

Consequently, in a state in which the insertion of the cartridge B is completed, the cartridge B is supported on the lower side of the tip portions 18*b*2 of the mounting guides 18*b* by the depth side of receiving surfaces 41*a*1 of guide grooves 41*a*. Then, the rear end corners 18*b*3 of the mounting guides 18*b* are lifted.

The moving guides 41 have a function of moving the cartridge B to a predetermined position of the main body 14 of the apparatus A and moves in association with opening and closing operations of the open/close cover 15.

Consequently, if the rear ends of the moving guides 41 (side ends of the open/close cover) can be pushed by the cartridge B, the moving guides 41 escape to the inside of the image forming apparatus A. Then, the mounting guides 18*b* of the cartridge B cannot be inserted into the guide grooves 41*a* of the moving guides 41.

Therefore, in this embodiment, the auxiliary guides 42, which are fixed to the side plates 40 and have mounting/dismounting assist portions 42*a* extending to the rear ends of the moving guides 41, are provided on the upstream side of the moving guides 41 in the mounting direction X of the cartridge B. The above-mentioned problems are solved by the auxiliary guides 42. Then, the mounting guides 18*b* are guided to the guide grooves 41*a* of the moving guides 41 reliably.

(Opening/Closing Mechanism for the Drum Shutter)

The state of inserting the cartridge B has been described. Next, opening and closing operations of the drum shutter 12 after the insertion will be hereinafter described.

In this embodiment, the opening and closing operations of the shutter 12 are not performed at a stage when the cartridge B is mounted to the main body 14 of the apparatus A (FIGS. 8 to 12) but are performed at a stage when the cartridge B moves in the inside of the main body 14 in accordance with the rotation of the open/close cover 15 (FIGS. 13 to 20).

That is, the shutter 12 is opened and closed at the stage when the cartridge B is moved by an operation for closing the open/close cover 15.

The cartridge B moves in association with the closing operation of the open/close cover 15, whereby the shutter 12 rotatably supported by the cartridge B rotates. Then, the transfer opening 9*a* and the exposure opening 9*b* are exposed to bring the cartridge B into a state in which an image can be formed.

Figure 13:
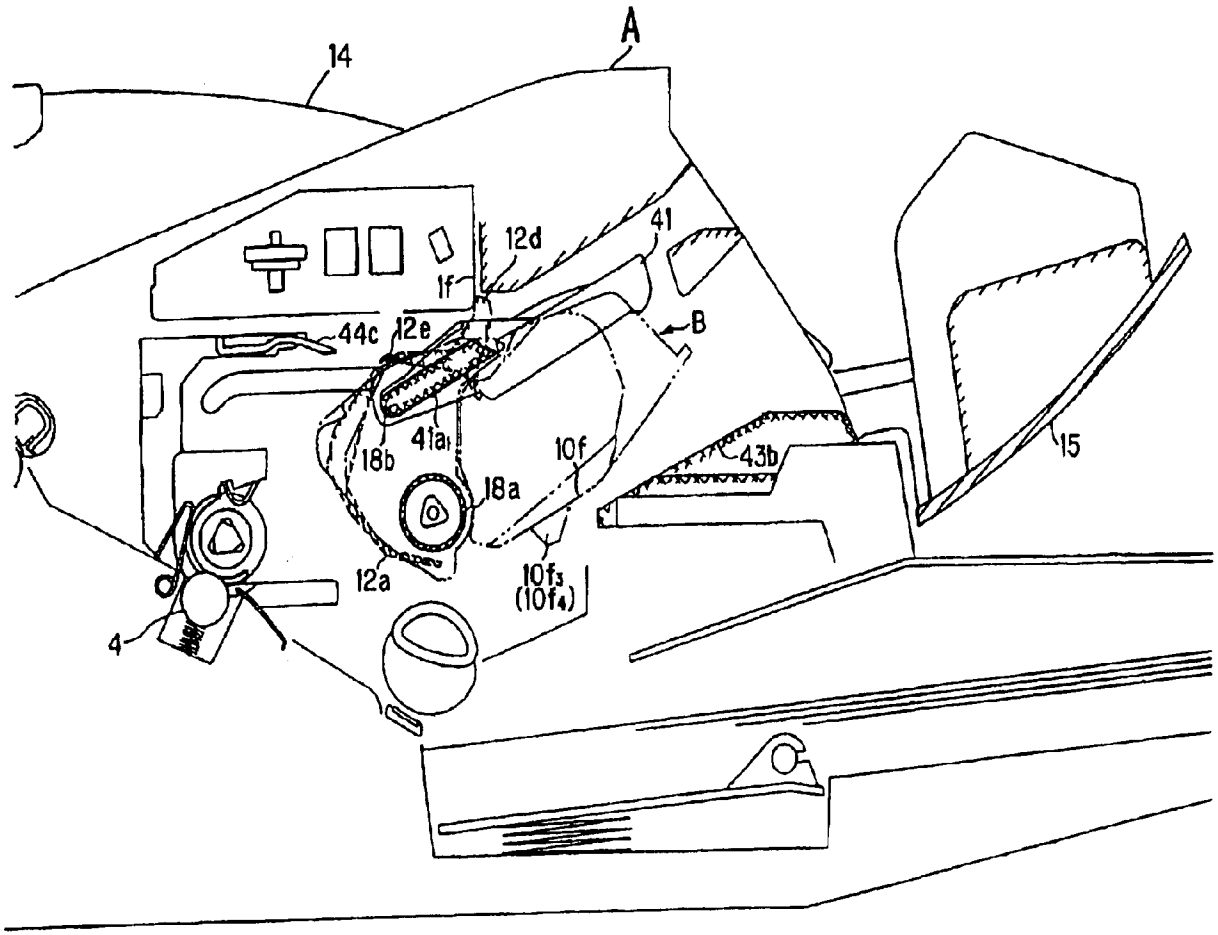
FIG. 13 is an operational explanatory view showing a movement of the process cartridge associated with a closing operation of the open/close cover.

More specifically, when the cartridge B moves in association with the closing operation of the open/close cover 15, as shown in FIG. 13, the cam portion 12*d* comes into contact with an optical plate 1*f* which is supported between the left and right side plates on which the optical system 1 is mounted in the main body 14. Then, the shutter 12 is rotated clockwise against a spring pressure of a shutter spring, consequently, the transfer opening 9*a* and the exposure opening 9*b* are started to be exposed.

Figure 14:
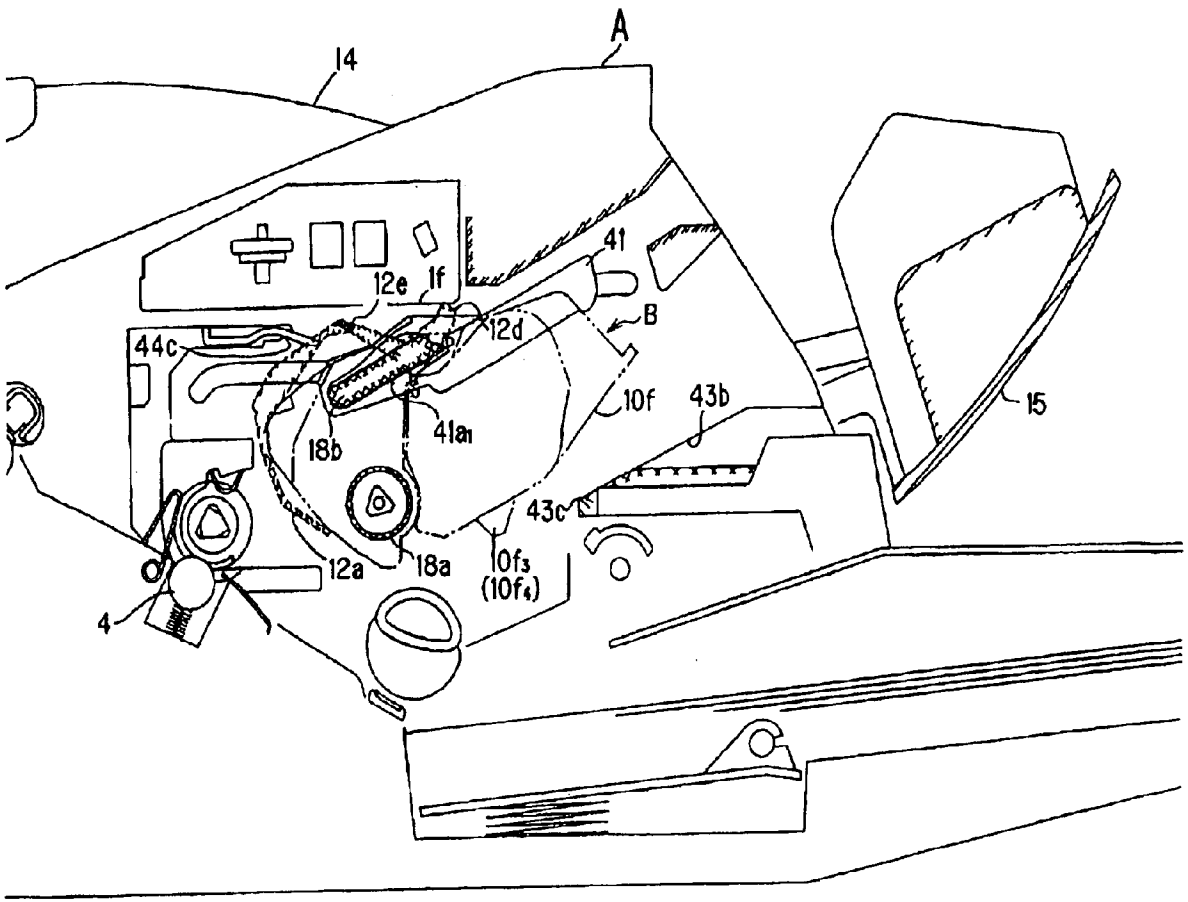
FIG. 14 is an operational explanatory view showing a movement of the process cartridge associated with the closing operation of the open/close cover.
Figure 15:
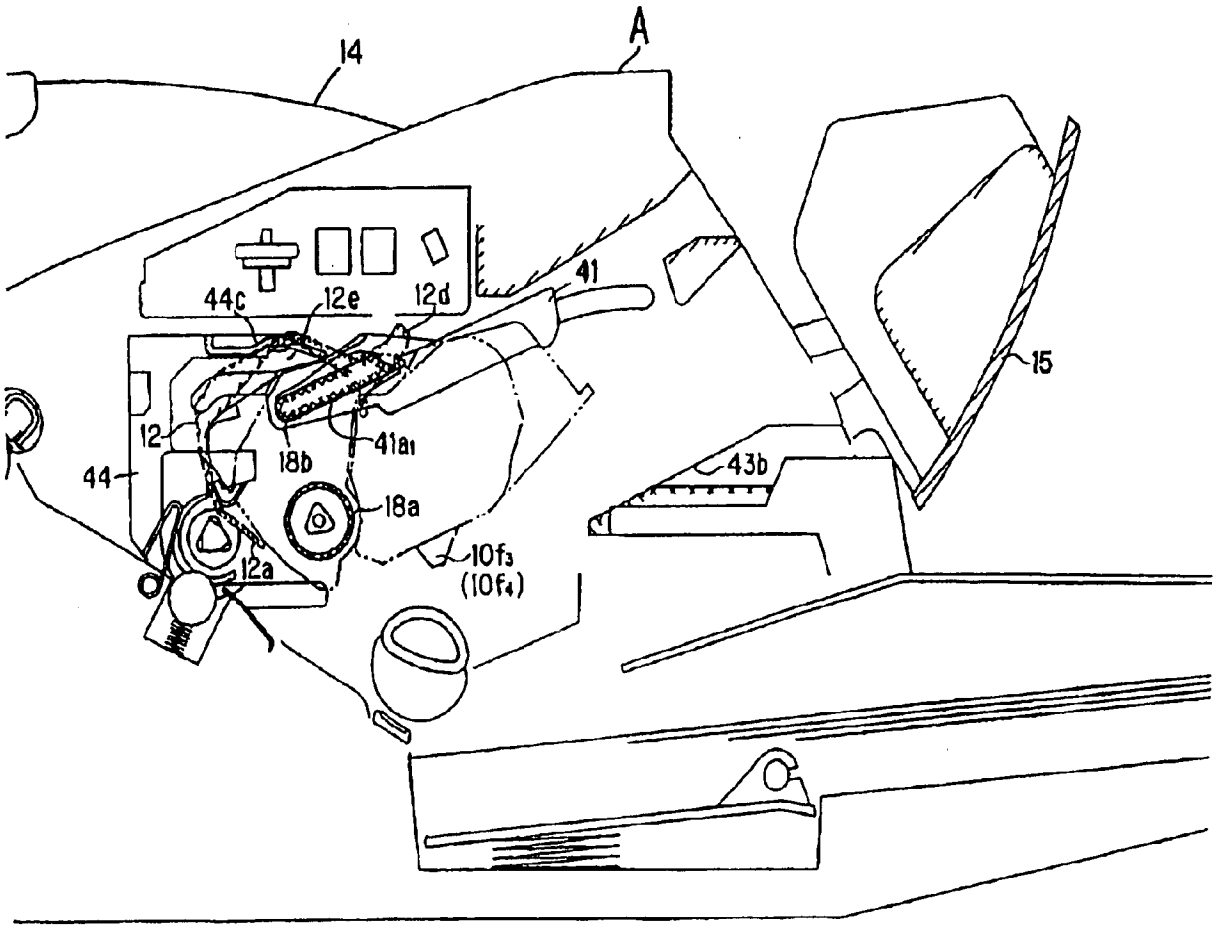
FIG. 15 is an operational explanatory view showing the movement of the process cartridge associated with the closing operation of the open/close cover.
Figure 16:
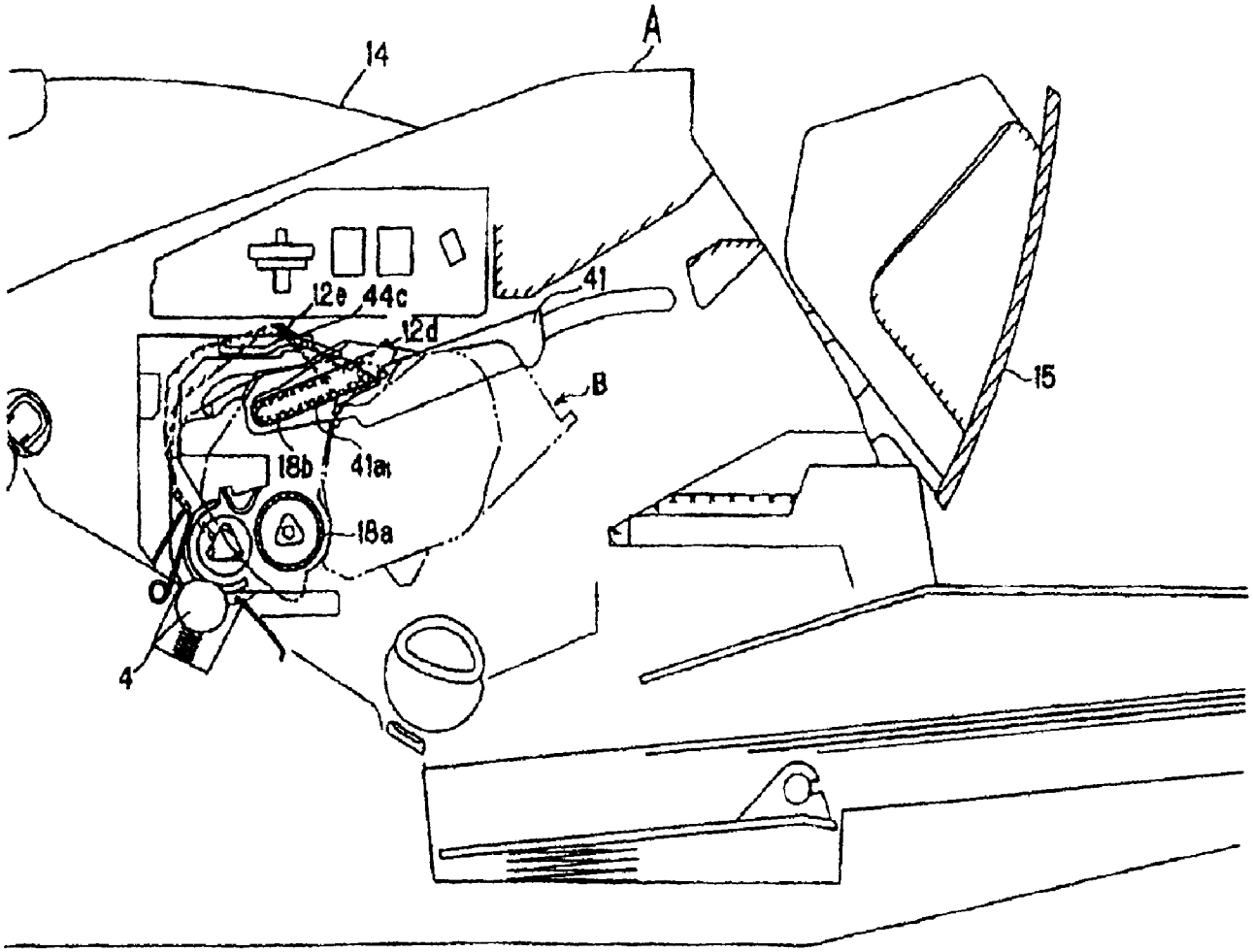
FIG. 16 is an operational explanatory view showing the movement of the process cartridge associated with the closing operation of the open/close cover.
Figure 17:
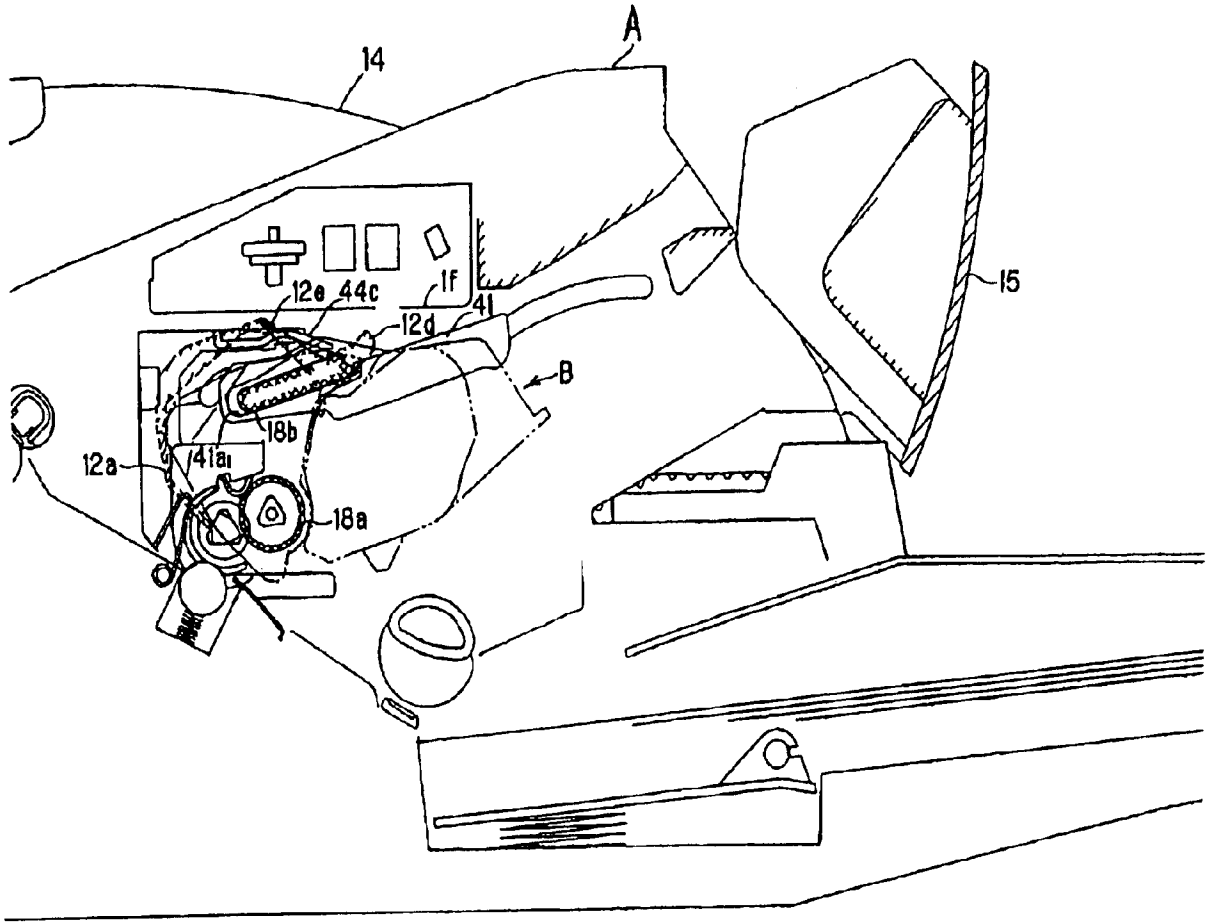
FIG. 17 is an operational explanatory view showing the movement of the process cartridge associated with the closing operation of the open/close cover.
Figure 18:
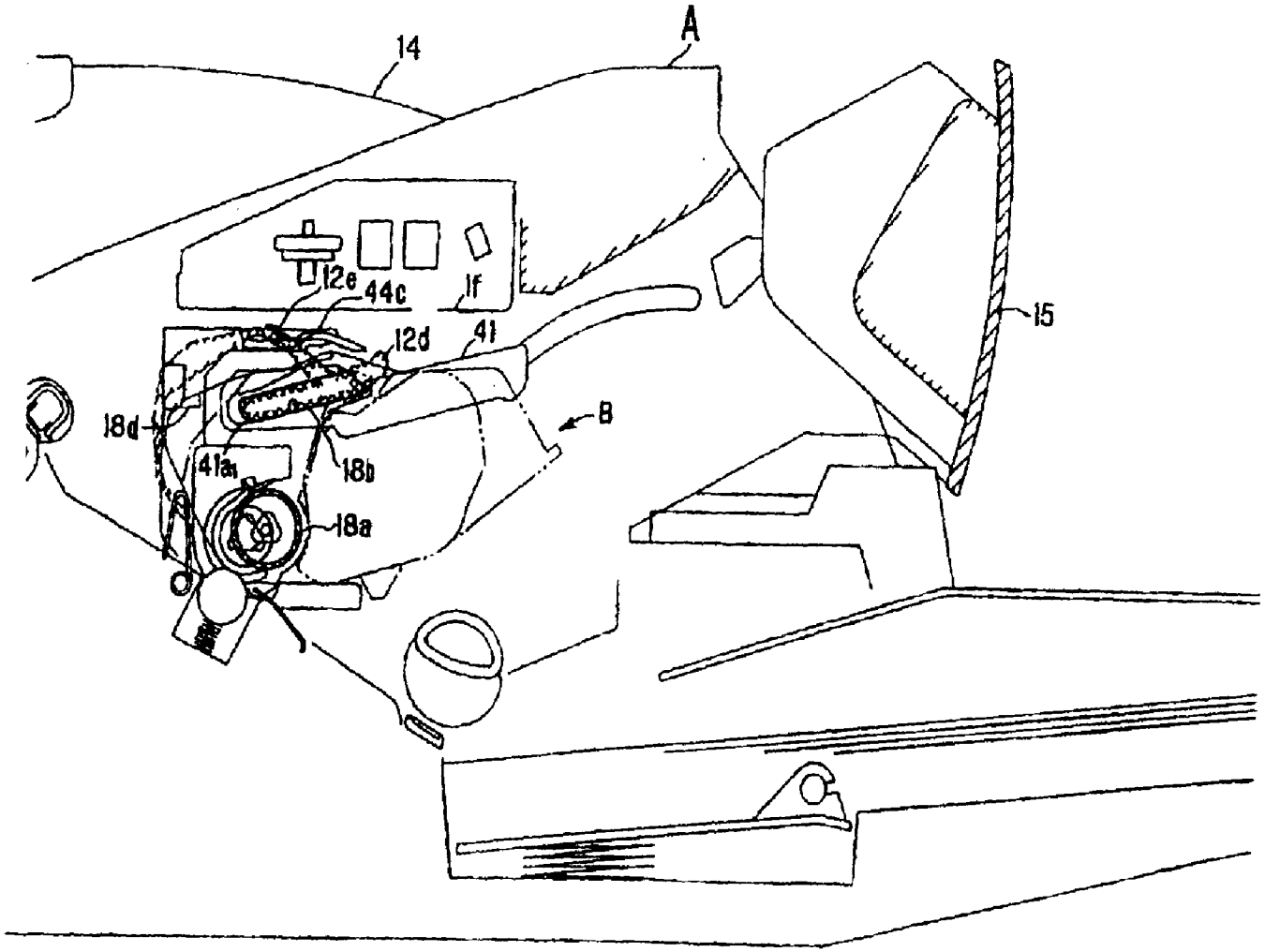
FIG. 18 is an operational explanatory view showing the movement of the process cartridge associated with the closing operation of the open/close cover.
Figure 19:
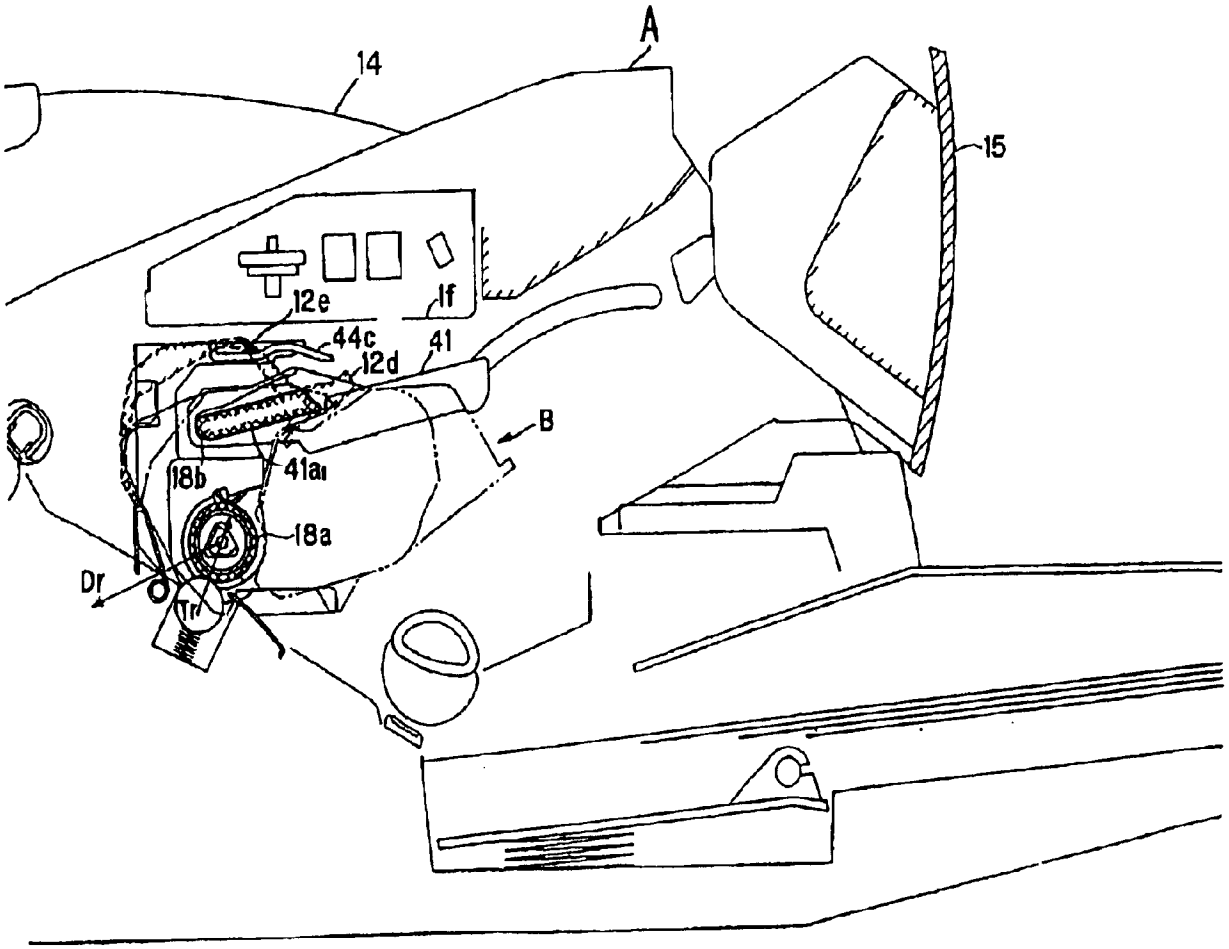
FIG. 19 is an operational explanatory view showing the movement of the process cartridge associated with the closing operation of the open/close cover.

When the cartridge B moves to the inner side in accordance with the closing operation of the open/close cover 15, the cam portion 12*d* of the shutter 12 comes into contact with a corner part of the optical plate 1*f*. Thereafter, as shown in FIG. 14, the shutter 12 moves while abutting a top portion 12*d*1 of the tip of the cam portion 12*d* against a lower surface of the optical plate 1*f*.

The cartridge B moves down to a conveying frame side, the shutter 12 increases its opening angle.

Figure 20:
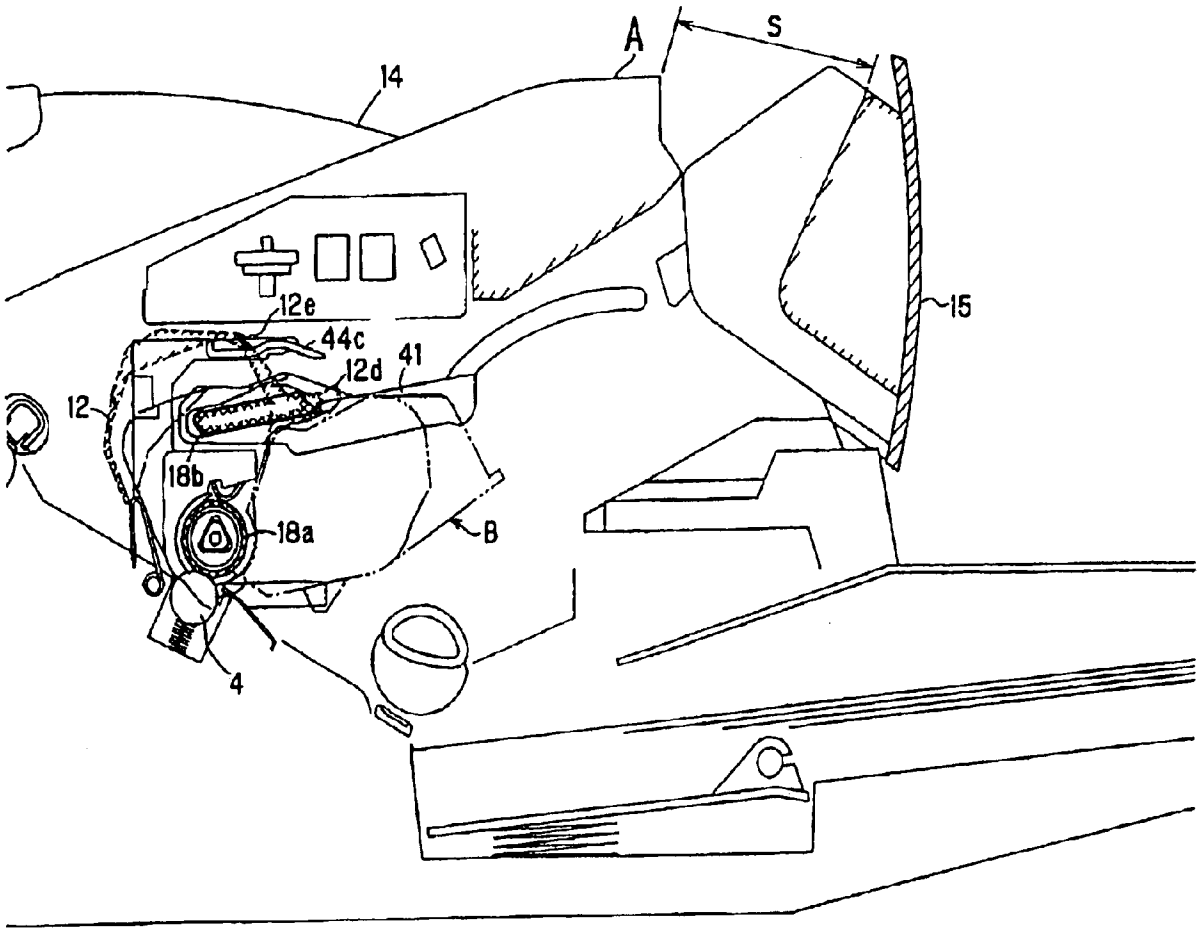
FIG. 20 is an operational explanatory view showing the movement of the process cartridge associated with the closing operation of the open/close cover.

Then, as shown in FIG. 20, the movement of the moving guides 41 associated with the rotation of the open/close cover 15 stops at a point when an opening amount of the open/close cover 15 has reached S. When the movement of the cartridge B following the movement of the moving guides 41 ends, the shutter 12 opens at a predetermined opening angle to expose the transfer opening 9*a* and the exposure opening 9*b*. Consequently, the cartridge B is brought into a state in which an image forming operation is possible.

Operations and mechanisms at the time when the cartridge B is inserted in an unconformable main body of an apparatus will be hereinafter described.

(Mounting of the Process Cartridge to an Improper Main Body of an Apparatus)

Figure 21:
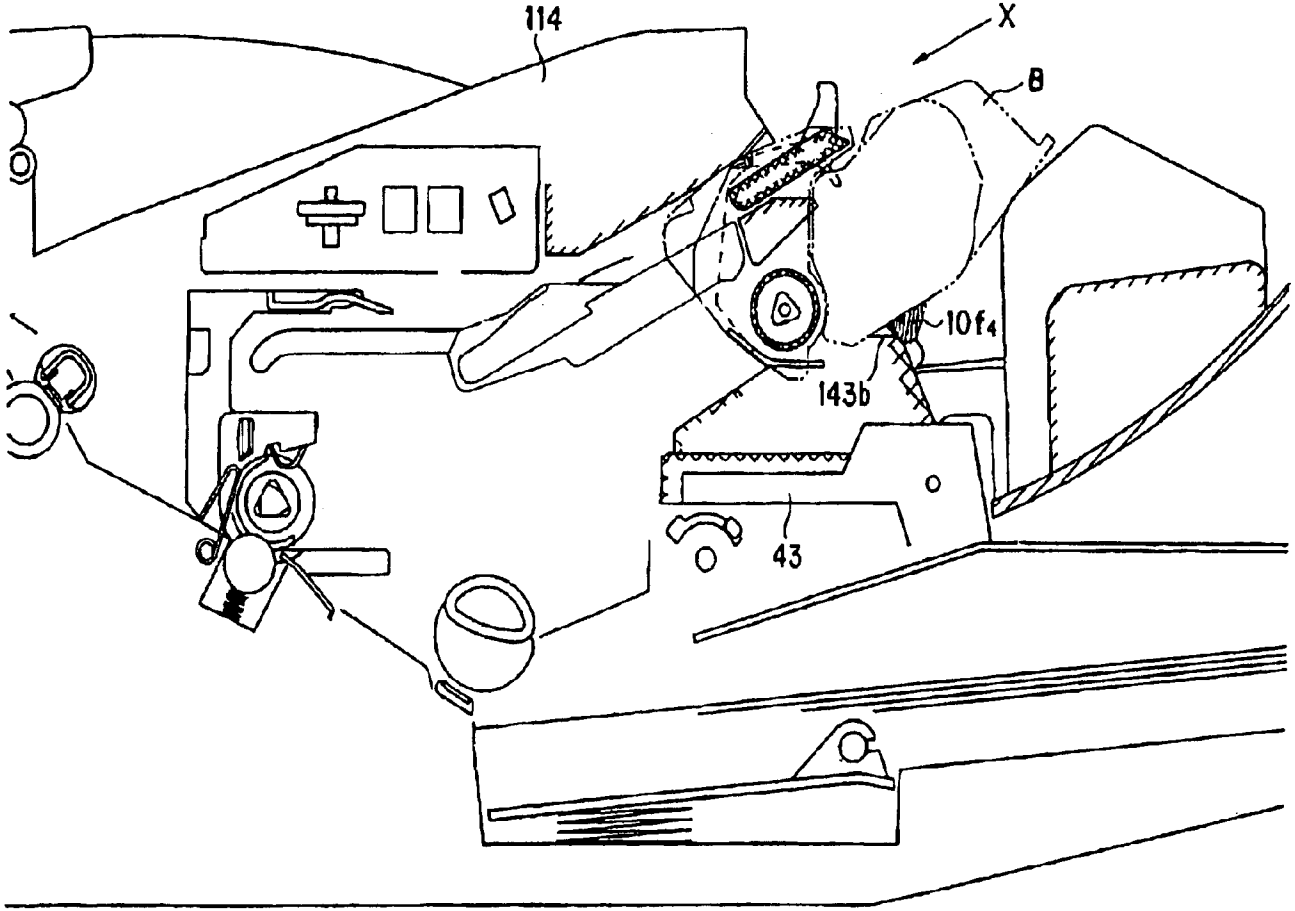
FIG. 21 is a main sectional view showing an image forming apparatus having different functions to which the process cartridge in accordance with an embodiment is attempted to be inserted.

Next, an erroneous insertion preventing operation according to an erroneous insertion preventing mechanism in inserting the cartridge B in an main body 114 of an apparatus with different functions in view of an image forming speed or the like will be described with reference to FIG. 21.

In other words, it describes about the case that the cartridge B is inserted into the main body 114 of the apparatus which is an unconformable in functions of the cartridge B and having different functions.

A structure of the main body 114 of an apparatus with functions different from those of the main body 14 is substantially identical with that of the main body 14 of the apparatus A except the following points.

In the main body 114 of an apparatus, side guides 143*b* of the front guide 43 arranged below the opening W are larger than the side guides 43*b* of the main body 14 (see FIG. 21).

When the cartridge B is inserted into this main body 114 of an apparatus, the projecting portions 10*f*4 of the cartridge B abut against the side guides 143*b* serving as a main body frame before the cartridge B is mounted in a predetermined position. Thus, at this point, the insertion ends in the vicinity of the opening W (FIG. 21). Here, the projecting portions 10*f*4 abutting against the side guides 143*b* may have a structure in which both ends thereof in the longitudinal direction abut against the side guides 143*b* or may have a structure in which one of both the ends abuts against the side guides 143*b*. That is, at least one end abuts against the side guides 143*b*.

(Mounting of an Improper Process Cartridge to a Proper Main Body of an Apparatus)

Figure 22:
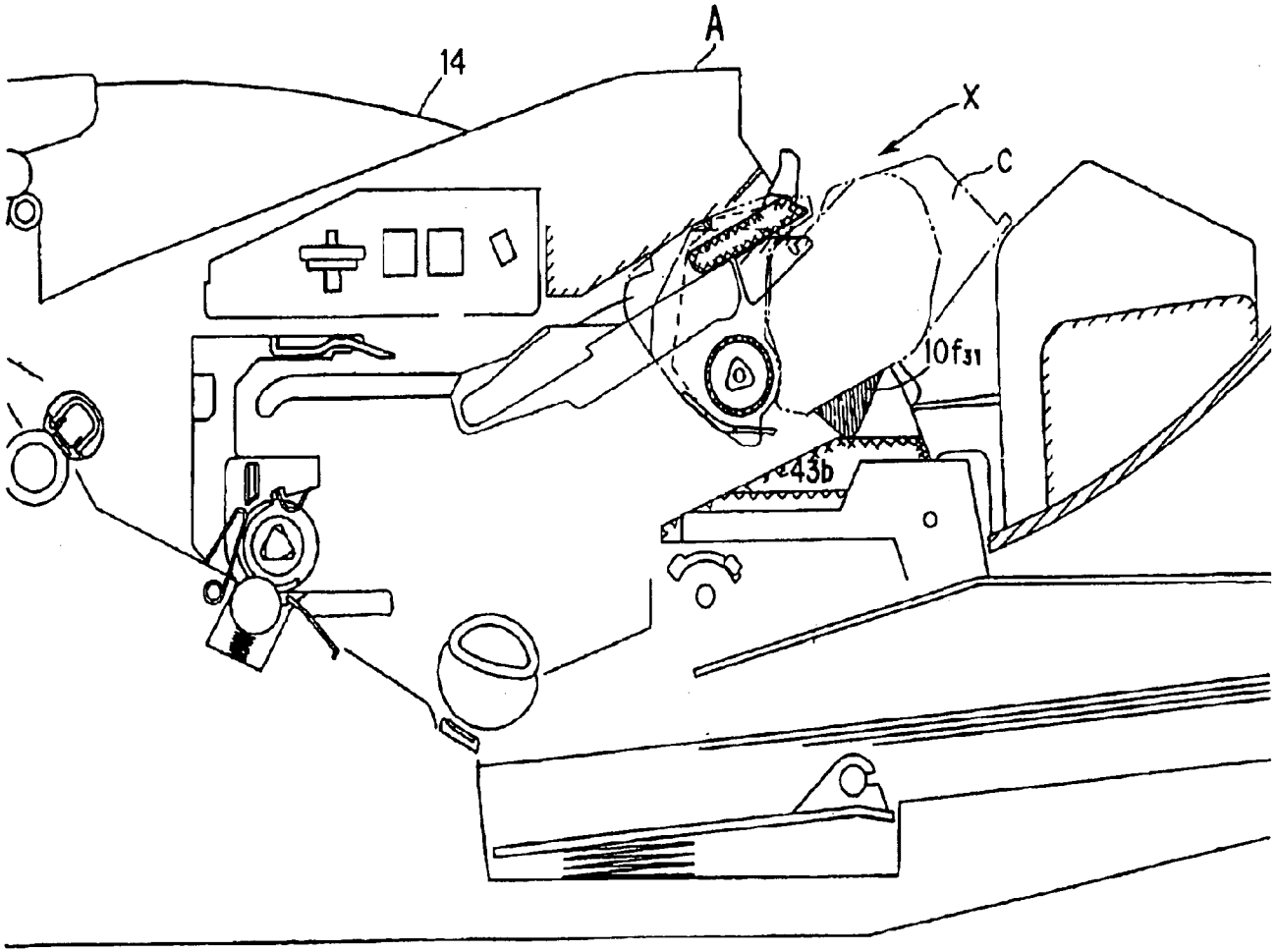
FIG. 22 is a main sectional view showing an image forming apparatus in accordance with the embodiment to which improper process cartridge is attempted to be inserted.

Next, an erroneous insertion preventing operation in inserting an improper process cartridge C into the main body 14 of the apparatus A will be described with reference to FIG. 22.

The cartridge C is different from the cartridge B in that the projecting portions 10*f*4 are not provided and leg portion 10*f*31 on the drive side is larger than the leg portion 10*f*3 and does not have a forked shape.

When the improper cartridge C is inserted into the main body 14 of the apparatus A, the leg portions 10*f*31 of the cartridge C abut against the side guides 43*b* of the main body 14 of the apparatus A before the cartridge C is mounted in a predetermined position. Thus, at this point, the insertion ends in the vicinity of the opening W (FIG. 22).

In addition, the cartridge C does not include the projecting portions 10*f*4 and is not guided by the side guides 43*b*. Therefore, the positioning of the cartridge C cannot be performed when the cartridge C is inserted. Consequently, a method of recognizing that the cartridge C is improper and stopping the insertion in the vicinity of the opening W can also be adopted.

The above-mentioned embodiment is summarized as described below.

The cartridge B detachably mountable to the main body 14 of the electrophotographic image forming apparatus A having the guide member (side guides 43*b*), includes: the cartridge frame CF; the electrophotographic photosensitive drum 7; the process means (the charging roller 8, the developing means 10, the cleaning means) acting on the electrophotographic photosensitive drum 7; and the projecting portion 10*f*4 which is provided in the cartridge frame CF and, when the process cartridge B is mounted to the main body 14 of the electrophotographic image forming apparatus A, is guided to the guide member (side guides 43*b*) to guide the process cartridge B in a mounting direction in which the process cartridge B is mounted to the main body 14 of the electrophotographic image forming apparatus A, in which, when the process cartridge B is mounted to the main body 14 of the electrophotographic image forming apparatus A which is conformable in functions of the process cartridge, the projecting portion **10*f*4 allows the process cartridge B to insert the main body 14 of the electrophotographic image forming apparatus A and, when the process cartridge B is mounted to the main body 114 of an electrophotographic image forming apparatus which is unconformable in functions of the process cartridge B and having different functions, the projecting portion 10*f*4 abuts against the main body frame (side guide 143*b*) provided in the main body 114** of the electrophotographic image forming apparatus having the different functions to prevent the mounting of the process cartridge B.

In addition, the projecting portion **10*f*4 includes: a first projecting portion (10*f*4*a*) which is provided on one end side of the cartridge frame CF in a longitudinal direction of the process cartridge B and, when the process cartridge B is mounted to the main body 14 of the electrophotographic image forming apparatus A, abuts against the guide member (side guides 43*b*); and a second projecting portion (10*f*4*b*) which is provided on the other end side of the cartridge frame CF in the longitudinal direction and, when the process cartridge B is mounted to the main body 14 of the electrophotographic image forming apparatus A, abuts against the guide member (side guides 43*b*), and when the process cartridge B is mounted to the main body 114 of the electrophotographic image forming apparatus which is unconformable in functions of the process cartridge and having different functions, at least one of the first projecting portion 10*f*4*a* and the second projecting portion 10*f*4*b* abuts against the main body frame (side guides 143*b*) provided in the main body 114** of the electrophotographic image forming apparatus having different functions to prevent the process cartridge B from being mounted thereto.

In addition, the projecting portion **10*f*4 is provided so as to project downward from the cartridge frame CF when the process cartridge B is mounted to the main body 14** of the electrophotographic image forming apparatus A.

In addition, one of the first and second projecting portions **10*f*4*a* and 10*f*4*b* is provided on the outer side in the longitudinal direction of the leg portion 10*f*3 (10*f*3*a*, 10*f*3*b***) provided in the cartridge frame CF in order to support the process cartridge B when the process cartridge B is mounted on the mounting surface.

In the above-mentioned respective cases, a cartridge can be recognized as an improper cartridge as insertion thereof ends.

Note that the above-mentioned main body of the apparatus with different functions is different not only in an image forming speed. For example, it is possible that a memory is mounted on the cartridge B and the main body of the apparatus is different in that it has or does not have a function for capable of receiving transmission of memory information thereof.

With the above-mentioned structure, according to this embodiment, a shape of the leg portions **10*f*3 formed at longitudinal ends of the cartridge B and provision of the projecting portions 10*f*4 on the outer side of the leg portions 10*f*3** easily make it possible to prevent erroneous insertion of the cartridge B into an improper main body of an apparatus (non-interchangeability) by only changing the parts at both ends in the longitudinal direction of the cartridge B.

In addition, in the case of erroneous insertion of the cartridge B into an improper main body of an apparatus, the insertion ends in the vicinity of an entrance of an opening of the apparatus main body (prevention of erroneous insertion) and the open/close cover does not close. Therefore, an improper relation between the parts is made clear to a user at an earlier stage. Consequently, improvement of usability can be easily realized.

Further, it becomes possible to divert a manufacturing process and a packing material without changing structures of frames of other process cartridges.

According to the above-mentioned embodiment, a projecting portion is provided at ends in a longitudinal direction of a process cartridge, and guide member corresponding to the projecting portion is provided in a proper main body of an electrophotographic image forming apparatus corresponding to the process cartridge. Consequently, a smooth cartridge inserting operation is realized.

In addition, even if the process cartridge is caused to be inserted in an improper main body of an electrophotographic image forming apparatus having different functions and not corresponding to the process cartridge, the projecting portion abuts against a main body frame of a main body cartridge insertion port of the main body. Thus, the process cartridge cannot be inserted further at that point, whereby erroneous insertion is prevented.

In addition, even if an improper process cartridge is caused to be inserted in the proper main body, the cartridge abuts against guide member of a main body cartridge insertion port of the main body. Thus, the process cartridge cannot be inserted further at that point, whereby erroneous insertion is prevented. Alternatively, the improper process cartridge is not guided by the guide member. Thus, positioning of the process cartridge cannot be performed at the time of insertion, whereby erroneous insertion is prevented.

Further, the first projecting portion and the second projecting portion are provided in a component arranged at longitudinal ends separately from the frame forming the central part of the process cartridge.

With the above-mentioned structure, non-interchangeability (corresponding to prevention of erroneous insertion) is realized without changing a size of a frame of a process cartridge. In addition, diversion of a process for a process cartridge assembly is facilitated, and even diversion of a package of the process cartridge can be realized easily.

In addition, according to the above-mentioned embodiment, at least one kind of frame (case) for plural kinds of process cartridges can be manufactured as a common component.

Further, since a difference in structures of process cartridges with different specifications is only presence or absence of a structure provided with a projecting portion at ends in the longitudinal direction of the process cartridge, diversion from the conventional structure can be easily performed.

Since a difference in structures for insertion of a process cartridge of apparatus main bodies is only that shapes of a guide member of the main bodies is adapted so as not to prevent insertion of a proper process cartridge. Thus, only when a process cartridge is mounted to the main bodies, the cartridge can be mounted in a predetermined position smoothly without any hindrance.

In addition, when an improper process cartridge is caused to be mounted, a leg portion of the cartridge abuts against a guide member of the main body. Therefore, the cartridge can be judged as improper.

Thus, reliable non-interchangeability can be given to the main body and the cartridge at relatively low cost without involving a large change in shapes in the main body and the cartridge. In addition, an open/close cover of the main body cannot be closed. Therefore, improvement of usability can also be realized easily.

In other words, non-interchangeability can be given to the main body and the cartridge, and this non-interchangeable shape also functions as inserting guide. In addition manufacturing cost can be reduced by sharing components including a frame (case) of a cartridge. Further, it is unnecessary to adopt useless means such as a sensor for judgment for giving interchangeability as in the past. Thus, not only the process cartridge but also the main body of the apparatus is not complicated in structure. From this point, there is also an effect that manufacturing cost can be reduced.

In addition, diversion of the conventional (wide variety of) assembly processes and assembly apparatuses becomes possible, and diversion of packing forms also becomes possible.

As described above, the process cartridge and the electrophotographic image forming apparatus of the present invention can be provided with non-interchangeability with a simple structure.

While the invention has been described with reference to the structure disclosed herein, it is not confined to the details set forth and this application is intended to cover such modifications or changes as may come within the purpose of the improvements or the scope of the following claims.

What is claimed is:

1. A process cartridge detachably mountable to a main body of an electrophotographic image forming apparatus having a guide member, comprising:

a cartridge frame;

an electrophotographic photosensitive drum;

a process unit acting on the electrophotographic photosensitive drum; and a projecting portion in the cartridge frame, wherein, when said process cartridge is mounted to the main body of the electrophotographic image forming apparatus, said projecting portion is guided by the guide member to guide said process cartridge in a mounting direction in which said process cartridge is mounted to the main body of the electrophotographic image forming apparatus, wherein, when said process cartridge is mounted to the main body of an electrophotographic image forming apparatus which conforms to functions of said process cartridge, said projecting portion allows said process cartridge to be inserted in the main body of the electrophotographic image forming apparatus that conforms to the functions of said process cartridge, and, wherein, when said process cartridge is mounted to a main body of an electrophotographic image forming apparatus which does not conform to the functions of said process cartridge and has different functions, said projecting portion abuts against a main body frame in the main body of the electrophotographic image forming apparatus having the different functions to prevent mounting of said process cartridge, wherein said projecting portion is provided so as to project downward from said cartridge frame, and when said process cartridge is withdrawn from the main body of the electrophotographic image forming apparatus to be mounted on a mounting surface, said projecting portion maintains a stable posture of said process cartridge.

2. A process cartridge according to claim 1, wherein said projecting portion comprises:

a first projecting portion provided on one end side of said cartridge frame in a longitudinal direction of said process cartridge and, when said process cartridge is mounted to the main body of the electrophotographic image forming apparatus, said first projecting portion abuts against the guide member; and a second projecting portion provided on another end side of said cartridge frame in the longitudinal direction and, when said process cartridge is mounted to the main body of the electrophotographic image forming apparatus, said second projecting portion abuts against the guide member, and wherein, when said process cartridge is mounted to the main body of the electrophotographic image forming apparatus which does not conform to the functions of the process cartridge and has different functions, at least one of said first projecting portion and said second projecting portion abuts against the main body frame in the main body of the electrophotographic image forming apparatus having the different functions to prevent said process cartridge from being mounted thereto.

3. An electrophotographic image forming apparatus for forming an image on a recording medium, wherein a process cartridge is detachably mountable to a main body of said electrophotographic image forming apparatus, said electrophotographic image forming apparatus, comprising:

(i) a guide member;

(ii) a mounting unit which is configured and positioned to detachably mount the process cartridge, the process cartridge comprising: a cartridge frame; an electrophotographic photosensitive drum; a process unit acting on the electrophotographic photosensitive drum; and a projecting portion which is provided in the cartridge frame and, when the process cartridge is mounted to the main body of said electrophotographic image forming apparatus, the projecting portion is guided by said guide member to guide the process cartridge in a mounting direction in which the process cartridge is mounted to the main body of said electrophotographic image forming apparatus, wherein, when the process cartridge is mounted to the main body of an electrophotographic image forming apparatus which conforms to functions of the process cartridge, the projecting portion allows the process cartridge to be inserted in the main body of the electrophotographic image forming apparatus conforming to the functions of the process cartridge and, when the process cartridge is mounted to a main body of an electrophotographic image forming apparatus which does not conform to the functions of the process cartridge and has different functions, the projecting portion abuts against a main body frame provided in the main body of the electrophotographic image forming apparatus having the different functions to prevent mounting of the process cartridge, the projecting portion being provided so as to project downward from the cartridge frame, and when the process cartridge is withdrawn from the main body of said electrophotographic image forming apparatus to be mounted on a mounting surface, the projecting portion and said main body maintain a stable posture of the process cartridge; and (iii) a conveying unit which conveys the recording medium.

4. An electrophotographic image forming apparatus according to claim 3, wherein the electrophotographic image forming apparatus that conforms to the functions of the process cartridge is different from the electrophotographic image forming apparatus having the different functions in the speed for forming an image on the recording medium.

5. A process cartridge mounting system which detachably mounts a process cartridge to an electrophotographic image forming apparatus, wherein a main body of the electrophotographic image forming apparatus comprises a guide member, said mounting system comprising a mounting unit configured and positioned to mount the process cartridge to the electrophotographic image forming apparatus, the process cartridge comprising a cartridge frame, an electrophotographic photosensitive drum, a process unit acting on the electrophotographic photosensitive drum, and a projecting portion provided in the cartridge frame and, when said mounting unit mounts the process cartridge to the main body of the electrophotographic image forming apparatus, the projecting portion is guided by the guide member to guide the process cartridge in a mounting direction in which the process cartridge is mounted to the main body of the electrophotographic image forming apparatus, wherein: when the process cartridge is mounted to a main body of an electrophotographic image forming apparatus which does not conform to functions of the process cartridge and has different functions therefrom, the projecting portion abuts against a main body frame provided in the main body of the electrophotographic image forming apparatus having the different functions to prevent mounting of the process cartridge, the projecting portion being provided so as to project downward from the cartridge frame, and when the process cartridge is withdrawn from the main body of the electrophotographic image forming apparatus to be mounted on a mounting surface, the projecting portion maintains a stable posture of the process cartridge, when the process cartridge is mounted to the main body of an electrophotographic image forming apparatus which does not conform to functions of the process cartridge and has different functions, the main body frame in the main body of the electrophotographic image forming apparatus having the different functions and the projecting portion abut against each other to prevent mounting of the process cartridge, and when the process cartridge is mounted to the main body of the electrophotographic image forming apparatus which conforms to the functions of the process cartridge, the projecting portion is guided in the mounting direction by the guide member, and the process cartridge is mounted to the main body of the electrophotographic image forming apparatus which conforms to the functions of the process cartridge by said mounting unit.

6. A process cartridge mounting system according to claim 5, wherein the projecting portion comprises:

a first projecting portion which is provided on one end side of the cartridge frame in a longitudinal direction of the process cartridge and, when said mounting unit mounts the process cartridge to the main body of the electrophotographic image forming apparatus, the first projecting portion abuts against the guide member; and a second projecting portion which is provided on another end side of the cartridge frame in the longitudinal direction and, when said mounting unit mounts the process cartridge to the main body of the electrophotographic image forming apparatus, the second projecting portion abuts against the guide member, and wherein, when the process cartridge is mounted to the main body of the electrophotographic image forming apparatus which does not conform to the functions of the process cartridge and has different functions, at least one of the first projecting portion and the second projecting portion abuts against the main body frame provided in the main body of the electrophotographic image forming apparatus having the different functions to prevent the process cartridge from being mounted thereto.

7. A process cartridge mounting system according to claim 5 or 6, wherein the electrophotographic image forming apparatus that conforms to the functions of the process cartridge is different from the electrophotographic image forming apparatus having the different functions in the speed for forming an image on recording medium.

8. A process cartridge detachably mountable to a main body of an electrophotographic image forming apparatus having a guide member, comprising:

an electrophotographic photosensitive drum;

a developing roller configured and positioned to develop an electrostatic latent image formed on said electrophotographic photosensitive drum;

a cleaning frame configured and positioned to support said electrophotographic photosensitive drum;

a toner development frame configured and positioned to support said developing roller; and a holder member which is provided at one longitudinal end of said process cartridge and connects said cleaning frame and said toner development frame, wherein said holder member has a projecting portion, wherein, when said process cartridge is withdrawn from the main body of the electrophotographic image forming apparatus to be mounted on a mounting surface, said projecting portion maintains a stable posture of said process cartridge, wherein, when said process cartridge is mounted to the main body of the electrophotographic image forming apparatus, said projecting portion is guided by the guide member to guide said process cartridge, and wherein, when said process cartridge is mounted to a main body of an electrophotographic image forming apparatus which does not conform to the functions of the process cartridge and has different functions therefrom, said projecting portion abuts against a main body frame provided in the main body of the electrophotographic image forming apparatus having different functions at a position such that an open/close cover, which closes an opening provided in the main body of the electrophotographic image forming apparatus having different functions, cannot close, to prevent said process cartridge from being inserted into the opening in the main body of the electrophotographic image forming apparatus having the different functions.

9. A process cartridge according to claim 8, wherein said holder member is provided at an one longitudinal end and the other longitudinal end of said process cartridge.

10. An electrophotographic image forming apparatus for forming an image on a recording medium, comprising:

(i) a guide member;

(ii) mounting means for detachably mounting a process cartridge, the process cartridge comprising an electrophotographic photosensitive drum, a developing roller developing an electrostatic latent image formed on the electrophotographic photosensitive drum, a cleaning frame supporting the electrophotographic photosensitive drum, a toner development frame supporting the developing roller, and a holder member which is provided at one longitudinal end of the process cartridge and connects the cleaning frame and the toner development frame, wherein the holder member has a projecting portion, wherein, when the process cartridge is withdrawn from the main body of said electrophotographic image forming apparatus to be mounted on a mounting surface, the projecting portion maintains a stable posture of the process cartridge, wherein, when said mounting means mounts the process cartridge to the main body of said electrophotographic image forming apparatus, the projecting portion is guided by the guide member to guide the process cartridge, and wherein when the process cartridge is mounted to a main body of an electrophotographic image forming apparatus which does not conform to functions of the process cartridge and has different functions therefrom, the projecting portion abuts against a main body frame provided in the main body of the electrophotographic image forming apparatus having the different functions at a position such that an open/close cover, which closes an opening provided in the main body of the electrophotographic image forming apparatus having different functions, cannot close, to prevent the process cartridge from being inserted into the opening in the main body of the electrophotographic image forming apparatus having the different functions; and (iii) conveying means for conveying the recording medium.

* * * * *